US009328509B2

(12) United States Patent
Takada

(10) Patent No.: US 9,328,509 B2
(45) Date of Patent: May 3, 2016

(54) SQUARE PIPE, FRAME STRUCTURE, SQUARE PIPE MANUFACTURING METHOD, AND SQUARE PIPE MANUFACTURING APPARATUS

(71) Applicant: TOPRE CORPORATION, Tokyo (JP)

(72) Inventor: Mikio Takada, Kanagawa (JP)

(73) Assignee: TOPRE CORPORATION, Kanagawa (JP)

( * ) Notice: Subject to any disclaimer, the term of this patent is extended or adjusted under 35 U.S.C. 154(b) by 0 days.

(21) Appl. No.: 14/636,699

(22) Filed: Mar. 3, 2015

(65) Prior Publication Data

US 2015/0176272 A1 Jun. 25, 2015

Related U.S. Application Data

(62) Division of application No. 12/647,758, filed on Dec. 28, 2009, now Pat. No. 9,010,168.

(30) Foreign Application Priority Data

Feb. 5, 2009 (JP) ..... 2009-024846

(51) Int. Cl.

| | |
|---|---|
| ***F16L 9/02*** | (2006.01) |
| ***E04B 2/58*** | (2006.01) |
| ***B21C 37/08*** | (2006.01) |
| ***B21C 37/15*** | (2006.01) |
| ***E04C 3/32*** | (2006.01) |

(52) U.S. Cl.

CPC ..... *E04B 2/58* (2013.01); *B21C 37/0803* (2013.01); *B21C 37/0815* (2013.01); *B21C 37/155* (2013.01); *E04C 3/32* (2013.01)

(58) Field of Classification Search

CPC ..... B21C 37/104

USPC ..... 138/177, 156, 151, 169, 178, DIG. 11; 72/368, 51, 52, 370.26

See application file for complete search history.

(56) References Cited

U.S. PATENT DOCUMENTS

| | | | | |
|---|---|---|---|---|
| 2,966,873 | A | 1/1961 | Hoffman et al. | |
| 6,601,427 | B2 * | 8/2003 | Kondou | B21C 37/104 72/368 |
| 6,983,770 | B2 * | 1/2006 | Kondou | B21C 37/104 138/151 |
| 7,134,456 | B2 * | 11/2006 | Maeda | B21D 5/015 138/151 |

(Continued)

FOREIGN PATENT DOCUMENTS

| | | |
|---|---|---|
| JP | 7-018485 | 3/1995 |
| JP | 11-290940 | 10/1999 |

(Continued)

*Primary Examiner* — Patrick F Brinson

(74) *Attorney, Agent, or Firm* — Greenblum & Bernstein, P.L.C.

(57) ABSTRACT

A square pipe manufacturing method includes: a first processing step of forming a first intermediate formed product 13 by bending both widthwise end portions of a rectangular metal plate 1; a second processing step of forming a second intermediate formed product 21 by bending both widthwise sides of a bottom surface 11 of the first intermediate formed product 13; a third processing step of obtaining a third intermediate formed product 23 by curving the side wall surfaces 17 to be convex outward in the width direction by pressing the flange parts 7, 7 toward the bottom wall surface 19 and then pressing the curved side wall surfaces 17 inward in the width direction; and a fourth processing step of crush-deforming corners 31, 31, 33, 33 of the third intermediate formed product 23.

1 Claim, 22 Drawing Sheets

(56) References Cited

U.S. PATENT DOCUMENTS

| | | | | |
|---|---|---|---|---|
| 8,522,593 | B2 | 9/2013 | Flehmig et al. | |
| 9,010,168 | B2 * | 4/2015 | Takada | B21C 37/0803 72/368 |
| 2001/0013242 | A1 * | 8/2001 | Kondou | B21C 37/104 72/379.2 |
| 2001/0020491 | A1 * | 9/2001 | Kondou | B21C 37/107 138/157 |
| 2004/0035166 | A1 | 2/2004 | Maeda et al. | |

FOREIGN PATENT DOCUMENTS

| | | |
|---|---|---|
| JP | 2003-245717 | 9/2003 |
| JP | 2003-260517 | 9/2003 |
| JP | 2004-034063 | 2/2004 |
| JP | 3974324 | 6/2007 |

* cited by examiner

SQUARE PIPE, FRAME STRUCTURE, SQUARE PIPE MANUFACTURING METHOD, AND SQUARE PIPE MANUFACTURING APPARATUS

CROSS-REFERENCE RELATED APPLICATIONS

The present application is a divisional of U.S. application Ser. No. 12/647,758, filed Dec. 28, 2009, the disclosures of which are incorporated herein by reference in its entirety.

BACKGROUND OF THE INVENTION

1. Field of the Invention

The present invention relates to a square pipe, a frame structure, a square pipe manufacturing method, and a square pipe manufacturing apparatus.

2. Description of the Related Art

There has heretofore been known a method for forming a square pipe having a closed rectangular cross section by the use of, for example, a metal plate such as a galvanized steel plate as a material (see, for example, Japanese Patent No. 3974324).

This forming method disclosed in Japanese Patent No. 3974324 is a method for forming a square pipe including a plurality of wall surfaces and having a rectangular cross section by use of an intermediate formed product. The intermediate formed product includes a bottom wall surface, side wall surfaces obtained by bending both sides of the bottom wall surface in its width direction at obtuse angles, and flange parts obtained by bending tip portions of the side wall surfaces. Specifically, the intermediate formed product is formed by bending a rectangular metal plate along a plurality of bend lines extending in a length direction of the metal plate. Particularly, a main feature of the method is to generate residual stress on the bottom wall surface of the intermediate formed product by curving the bottom wall surface into a downward convex shape and then planarizing the curved bottom wall surface by vertical compression. Here, the residual stress causes the flange parts forming a top wall surface to come into close contact with each other.

However, in the above forming method described in Japanese Patent No. 3974324, the residual stress generated on the bottom wall surface may cause the bottom wall surface of the completed square pipe to be curved into a convex or concave shape even though only slightly. Therefore, it has been difficult to obtain the rectangular cross section in a reliable manner. Moreover, there has been a problem that it is difficult for the residual stress on the bottom wall surface to bring the flange parts into close contact with each other surely and evenly.

SUMMARY OF THE INVENTION

The present invention has been achieved with such points in mind.

It therefore is an object of the present invention to provide a square pipe, a frame structure, a square pipe manufacturing method, and a square pipe manufacturing apparatus, in which and with which figure of a cross section of the square pipe becomes right rectangle so that the flange parts of the manufactured square pipe can be brought into close contact with each other surely and evenly.

To achieve the above object, a square pipe manufacturing method of the present invention includes: a first processing step of forming a first intermediate formed product by bending both widthwise end portions of a rectangular metal plate along first bend lines each extending in a length direction of the metal plate, the first intermediate formed product having the both widthwise end portions as flange parts and a widthwise center portion as a bottom surface; a second processing step of forming a second intermediate formed product by bending each of both widthwise sides of the bottom surface of the first intermediate formed product at an obtuse angle relative to a widthwise center portion of the bottom surface along a second bend line extending in a length direction of the bottom surface, the second intermediate formed product having the both widthwise sides of the bottom surface as side wall surfaces and the widthwise center portion of the bottom surface as a bottom wall surface; a third processing step of obtaining a third intermediate formed product formed to have a closed rectangular cross section by allowing the flange parts in the second intermediate formed product to butt against each other; and a fourth processing step of crush-deforming corners of the third intermediate formed product and generating residual stresses on the corners by the crush-deformation, the corners crush-deformed by compressing the flange parts and the bottom wall surface arranged opposite to the flange parts in the third intermediate formed product in a direction of bringing the flange parts and the bottom wall surface relatively close to each other, the residual stresses bringing the pair of flange parts into close contact with each other.

Therefore, according to the present invention, since it is possible to allow the residual stress to act not on the bottom wall surface but on the corners of the square pipe, the figure of the cross section of the manufactured square pipe becomes right rectangle, thereby bringing the flange parts of the manufactured square pipe into close contact with each other surely and evenly.

BRIEF DESCRIPTION OF THE ACCOMPANYING DRAWINGS

Figure 4A:
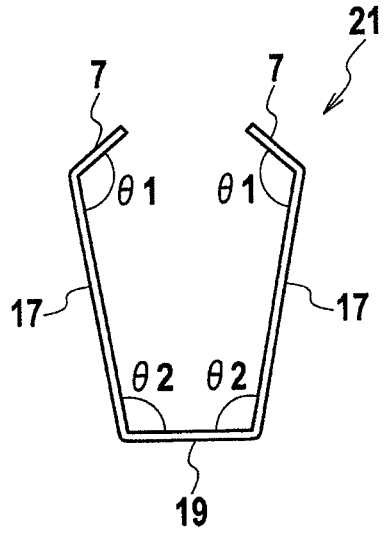
Figure 4B:
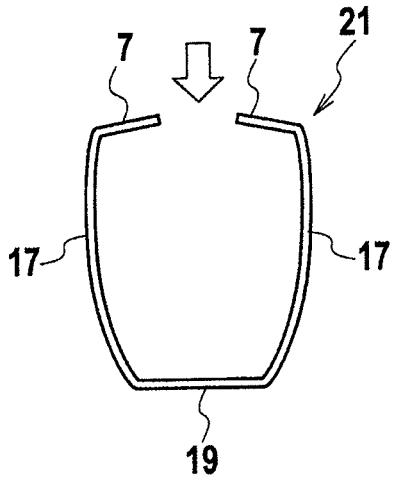
Figure 4C:
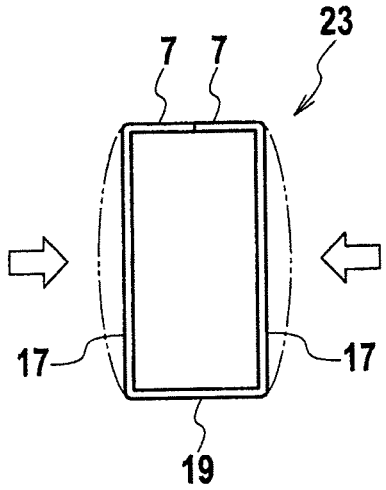

FIGS. 4A through 4C are front views showing a third processing step of forming a third intermediate formed product in the steps of manufacturing the square pipe according to the first embodiment of the present invention, FIG. 4A showing the second intermediate formed product, FIG. 4B showing a state where flange parts of the second intermediate formed product are pressed to curve side wall surfaces into convex shapes, and FIG. 4C showing a state where the side wall surfaces curved into the convex shapes are pressed inward in a width direction to form a closed rectangular cross section.

Figure 5A:
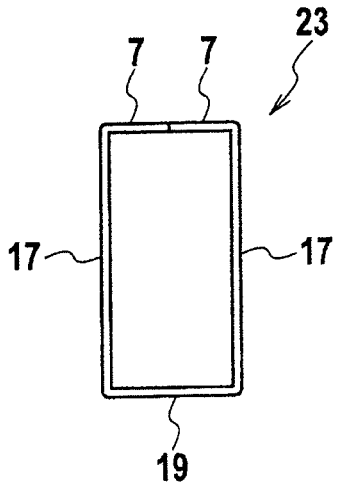
Figure 5B:
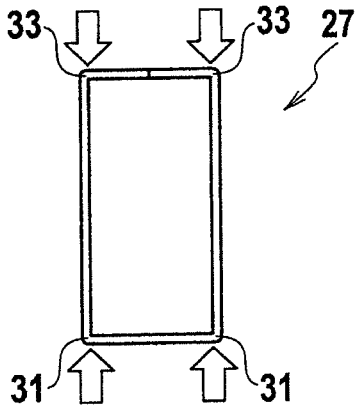
Figure 5C:
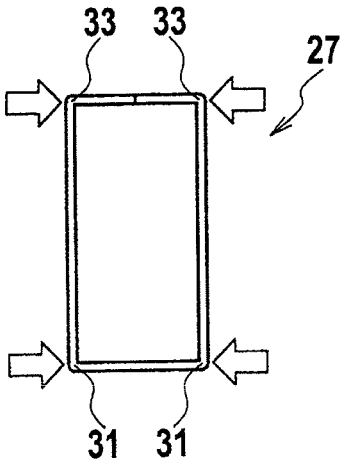

FIGS. 5A through 5C are front views showing a fourth processing step of crush-deforming corners in the steps of manufacturing the square pipe according to the first embodiment of the present invention, FIG. 5A showing the third intermediate formed product, FIG. 5B showing a state where corners of the third intermediate formed product are crush-deformed with the application of loads to the corners in a vertical direction, and FIG. 5C showing a state where the corners of the third intermediate formed product are crush-deformed with the application of loads to the corners inward in the width direction.

Figure 6:
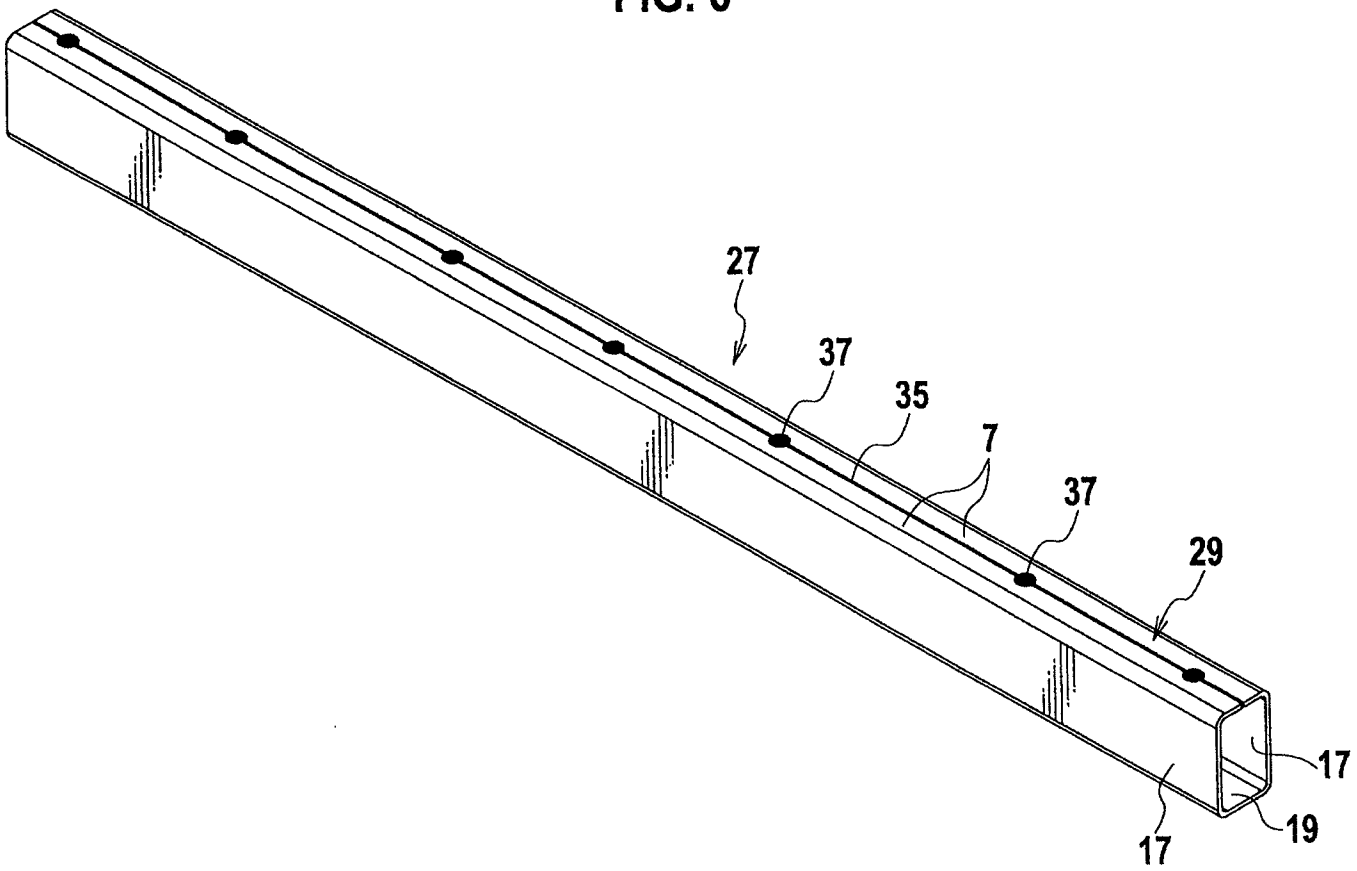

FIG. 6 is a perspective view showing the square pipe according to the first embodiment of the present invention.

Figure 7C:
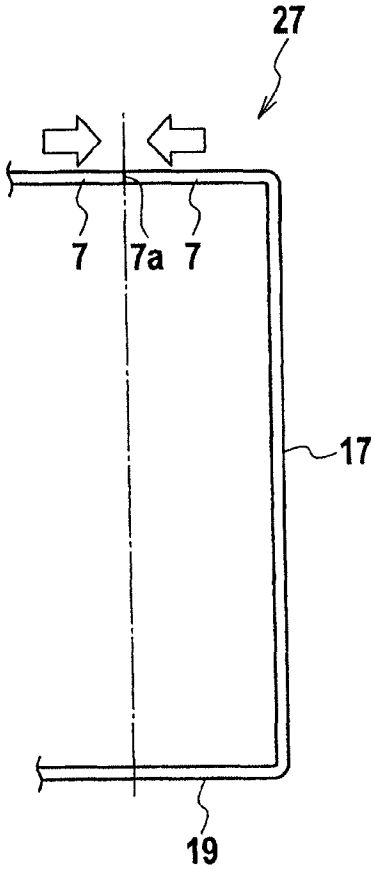
Figure 7B:
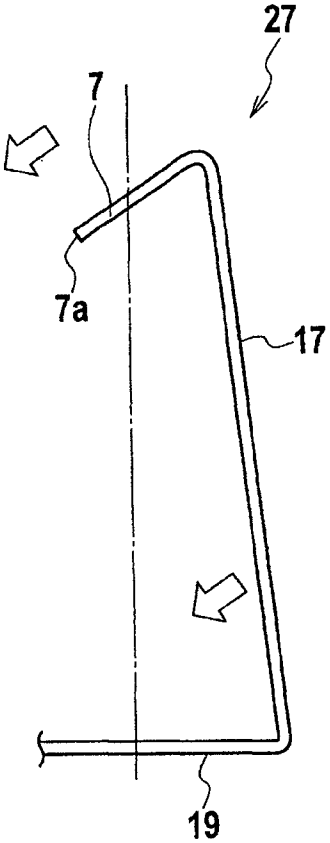
Figure 7A:
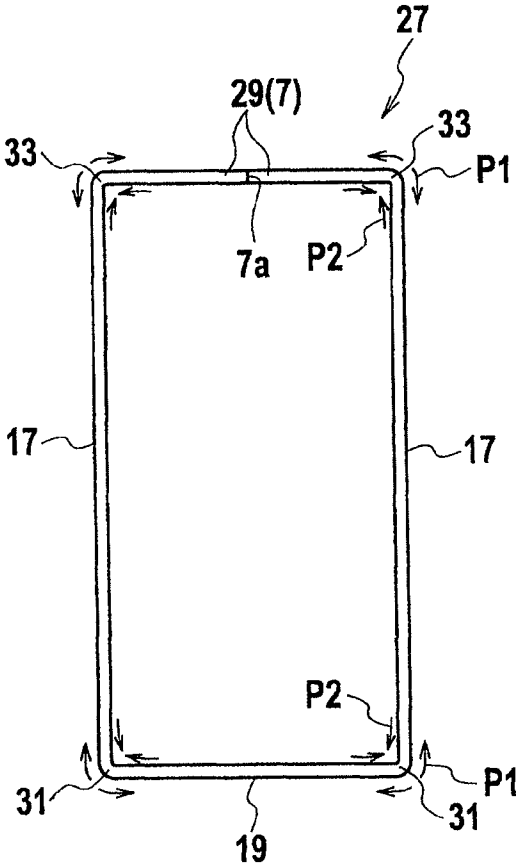

FIG. 7A is a front view schematically showing residual stresses in the square pipe according to the first embodiment of the present invention, FIG. 7B is a front view schematically showing, in the case where the flange part on one side is removed, movement of the side wall surface on the other side, and FIG. 7C is a front view schematically showing, in the case where the flange part on one side exists, stresses of the flange parts on one side and the other side pushing against each other.

Figure 8:
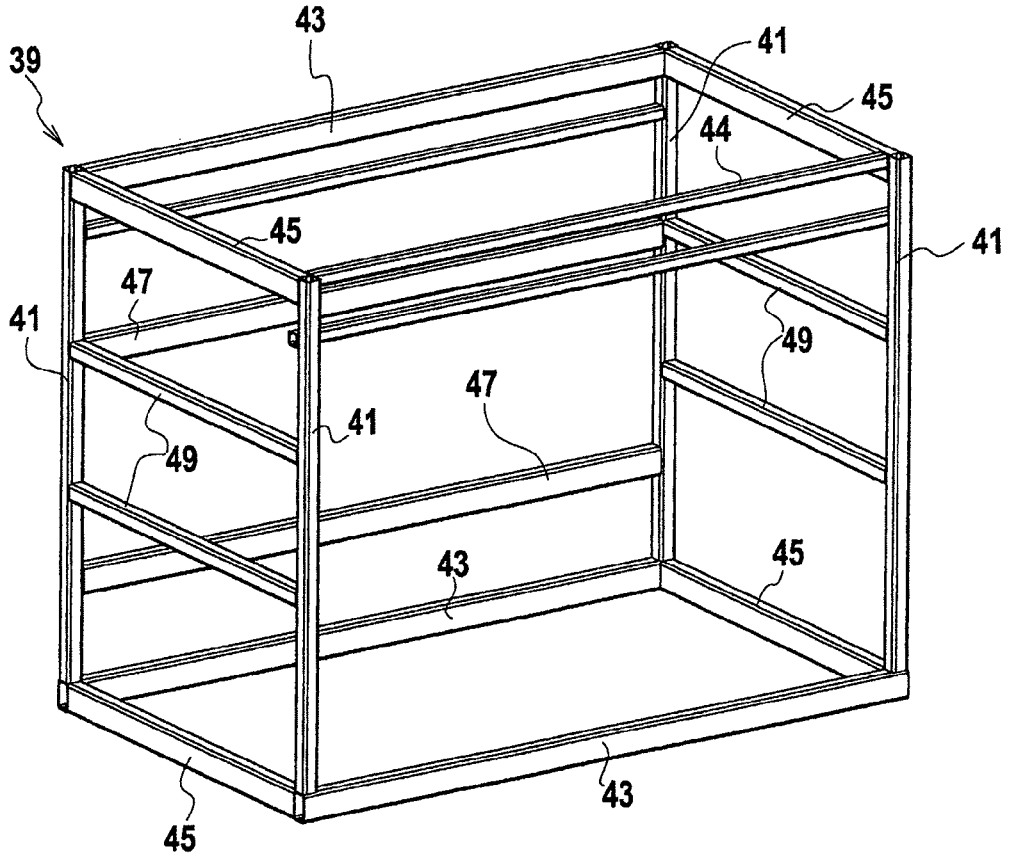

FIG. 8 is a perspective view showing a frame structure using the square pipes according to the first embodiment of the present invention.

Figure 9:
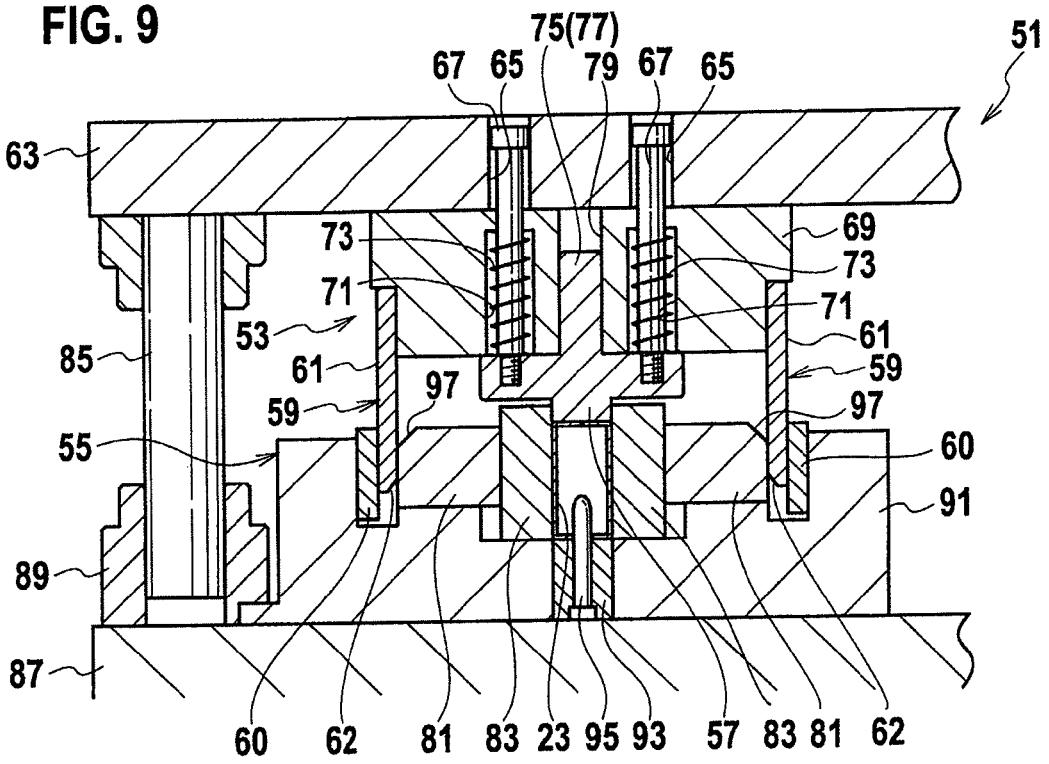

FIG. 9 is a cross-sectional view showing a square pipe manufacturing apparatus according to a second embodiment of the present invention.

Figure 10:
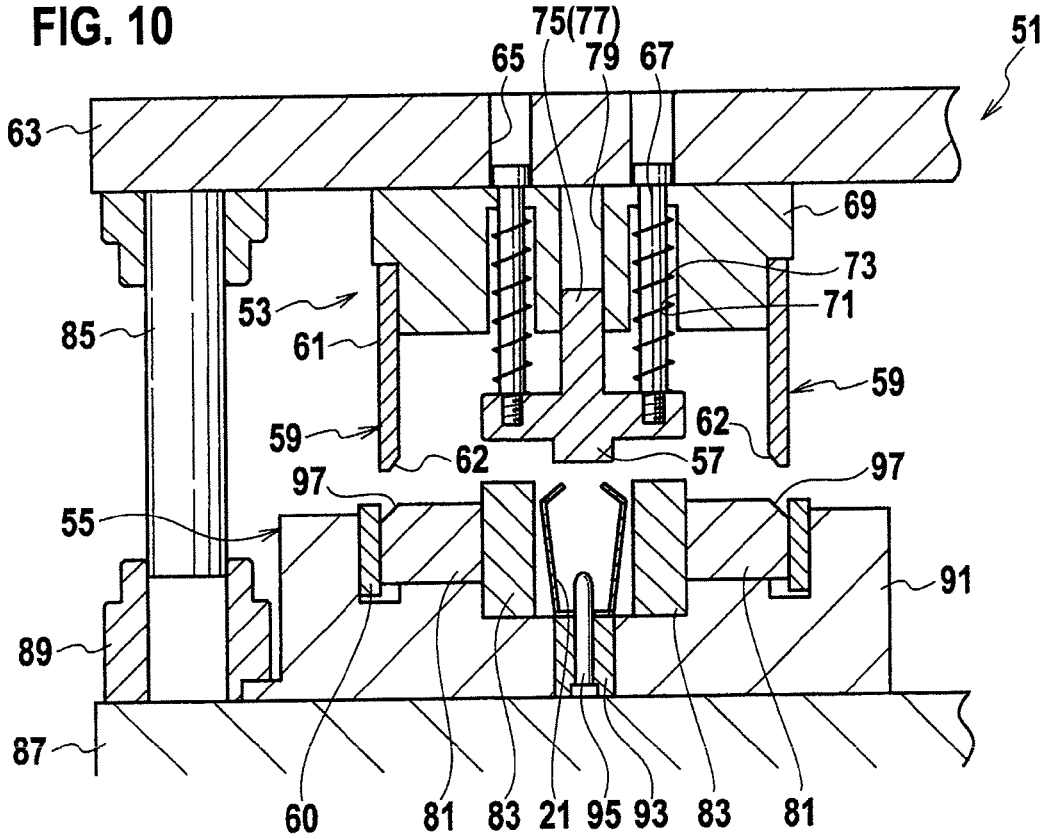

FIG. 10 is a cross-sectional view showing a step of forming a square pipe by use of the manufacturing apparatus shown in FIG. 9 and showing a state where the second intermediate formed product is set in a die.

Figure 11:
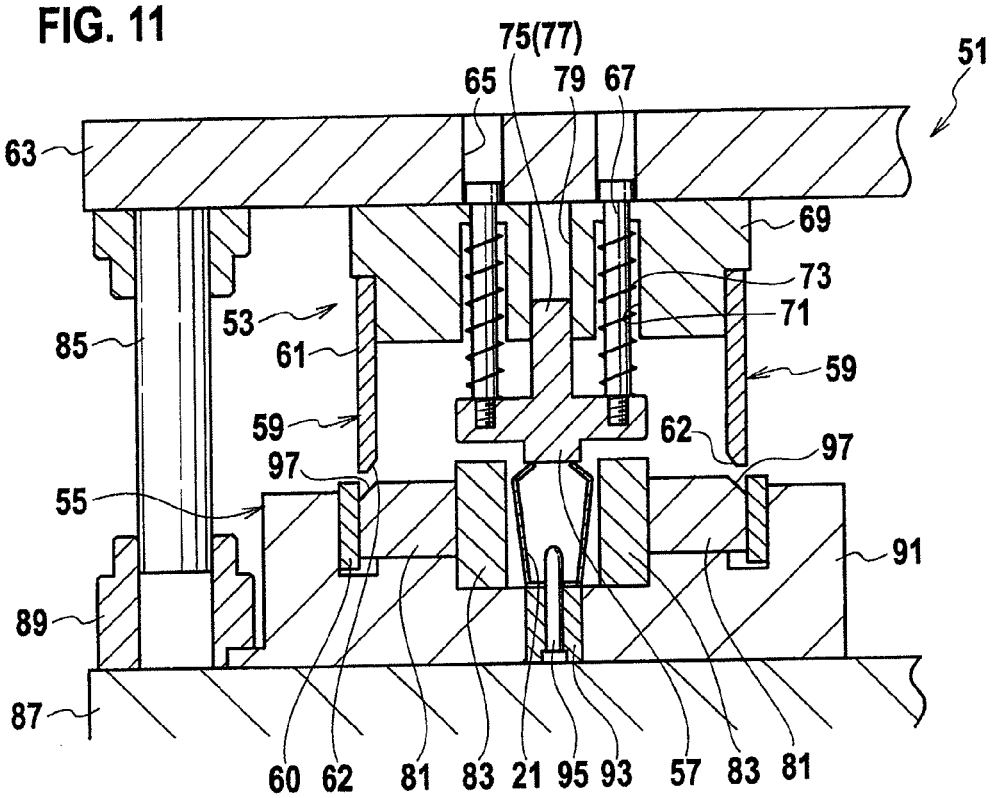

FIG. 11 is a cross-sectional view showing a step of forming the square pipe by use of the manufacturing apparatus shown in FIG. 9 and showing a state where an upper die is lowered and a pressing block presses flange parts of the second intermediate formed product.

Figure 12:
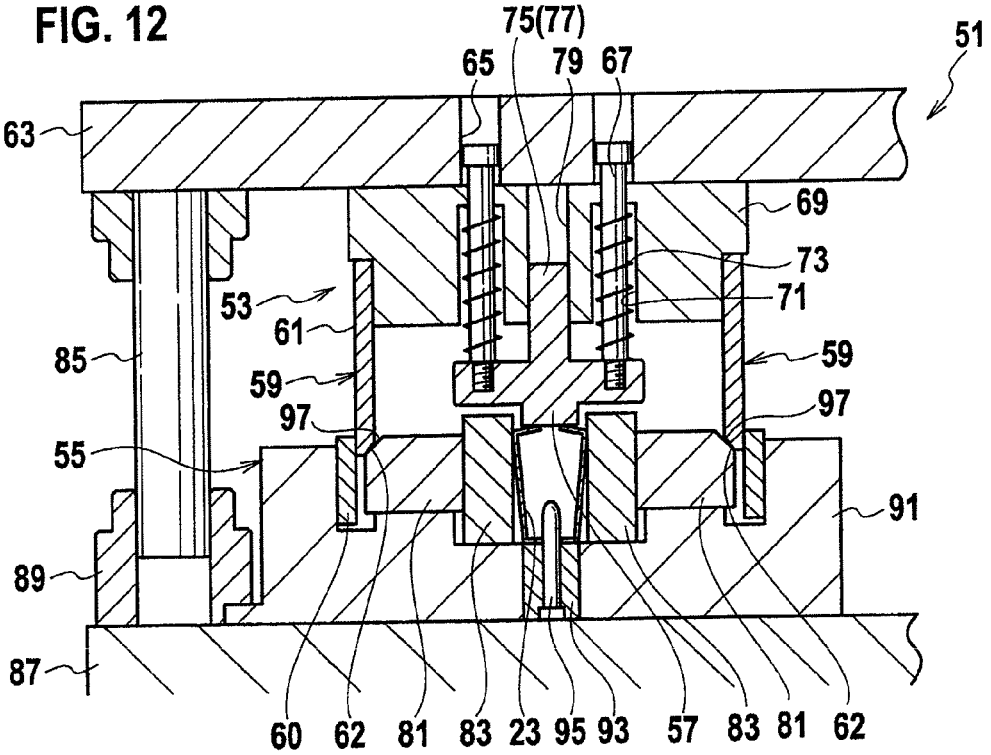

FIG. 12 is a cross-sectional view showing a step of forming the square pipe by use of the manufacturing apparatus shown in FIG. 9 and showing a state where slide cams in a lower die press side wall surfaces of the second intermediate formed product inward in a width direction.

Figure 13:
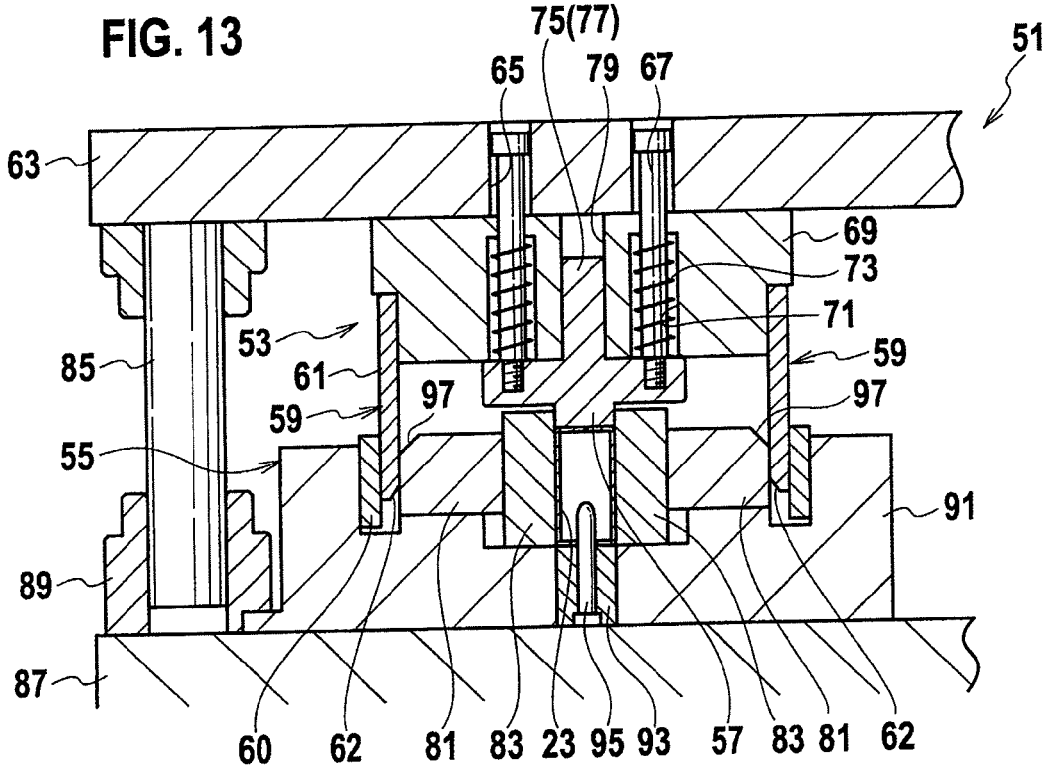

FIG. 13 is a cross-sectional view showing a step of forming the square pipe by use of the manufacturing apparatus shown in FIG. 9 and showing a state where the pressing block in the upper die and the slide cams in the lower die press the flange parts and side wall surfaces of the second intermediate formed product.

Figure 14:
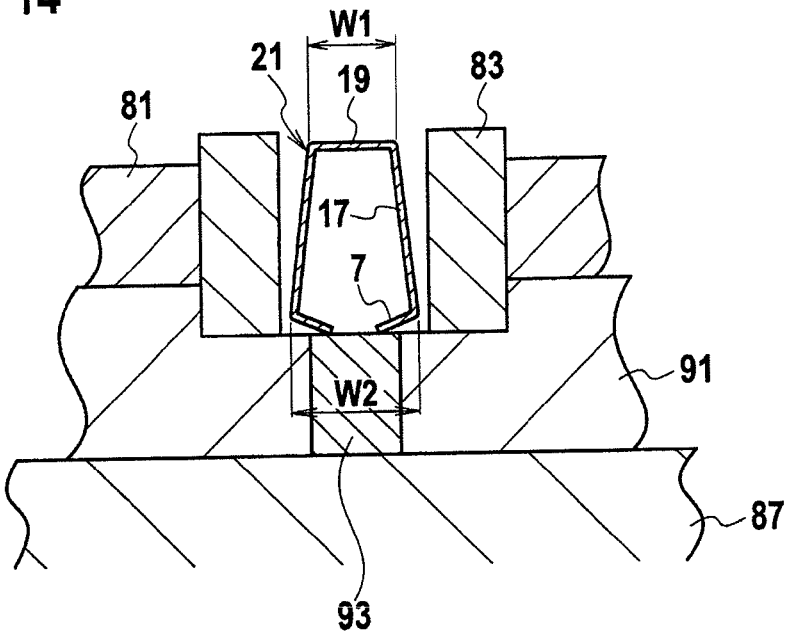

FIG. 14 is a cross-sectional view showing a forming method according to a modified example of the second embodiment and showing a state where the second intermediate formed product is set in a die upside down with respect to that of FIG. 10.

Figure 15:
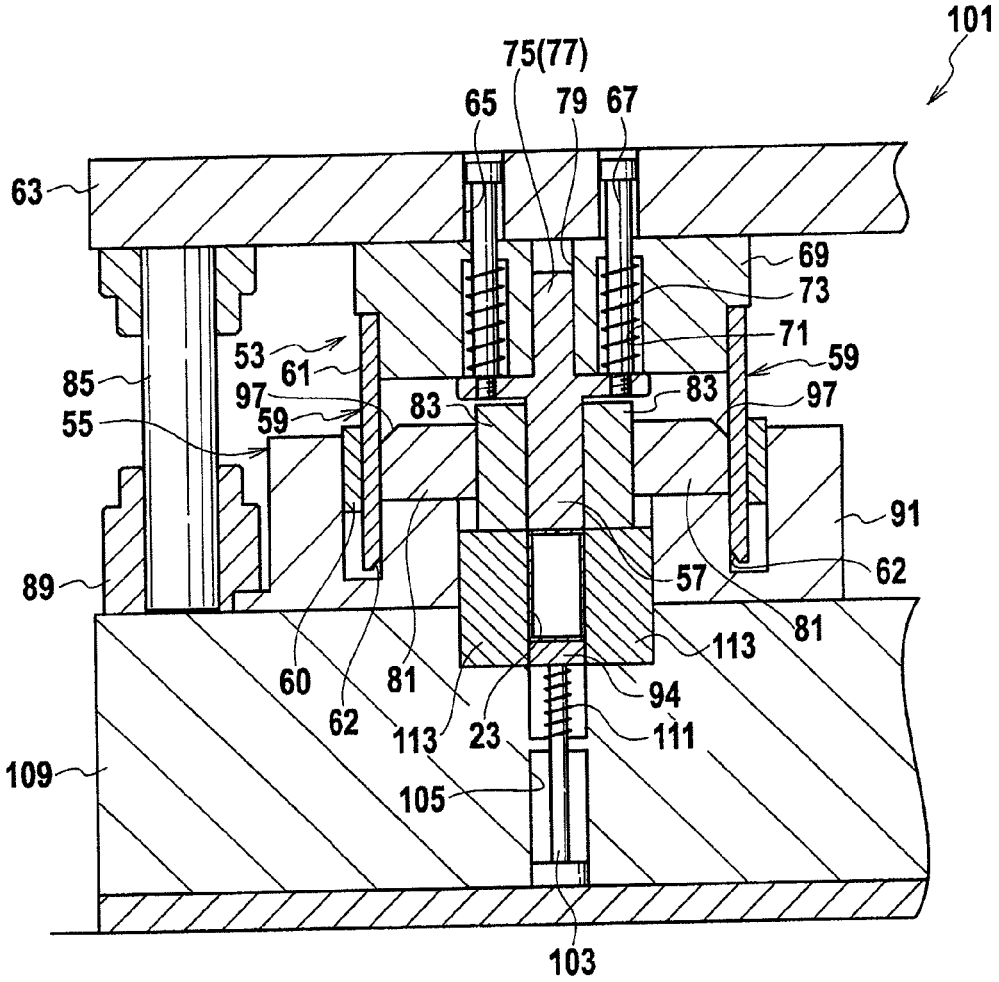

FIG. 15 is a cross-sectional view showing a square pipe manufacturing apparatus according to a third embodiment of the present invention.

Figure 16:
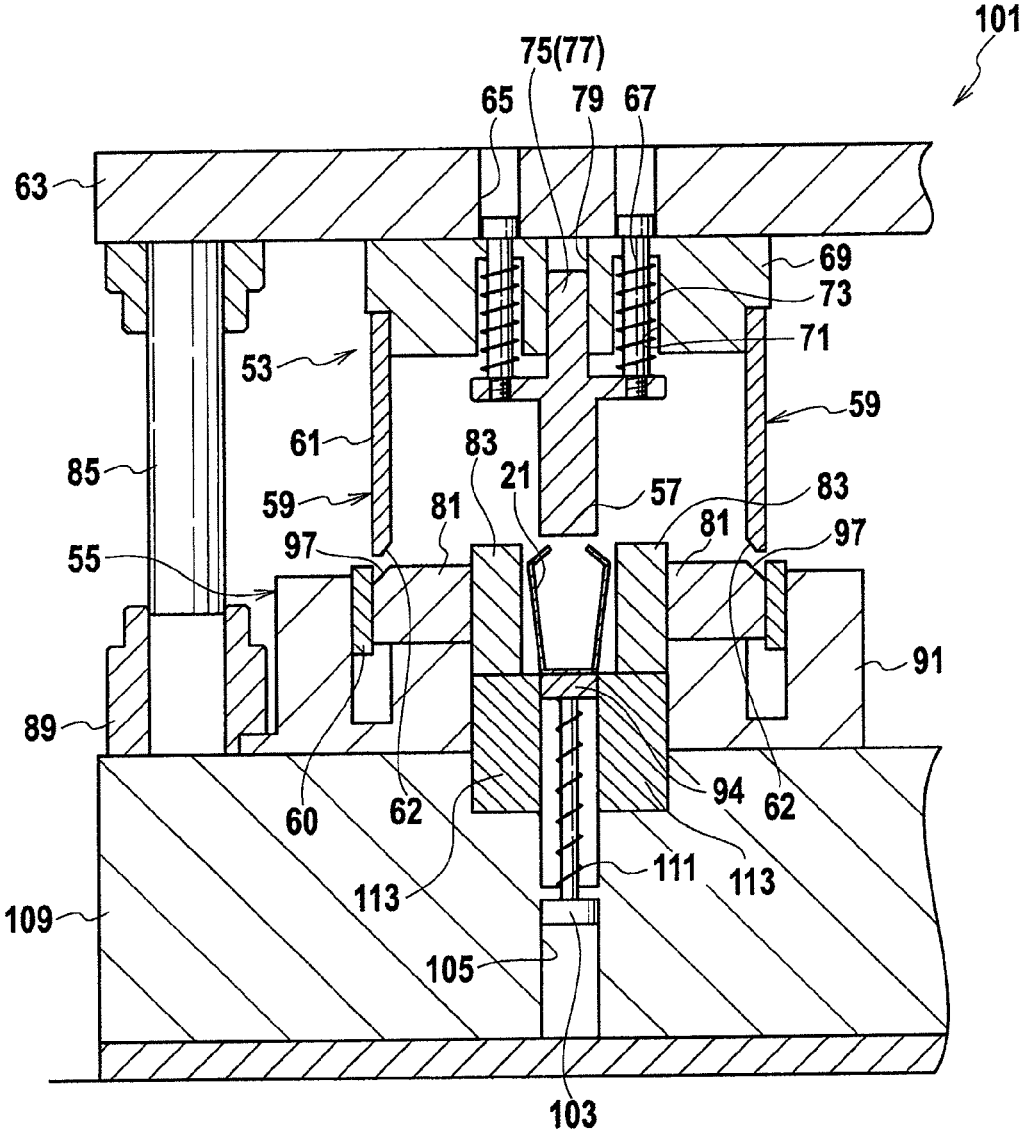

FIG. 16 is a cross-sectional view showing a step of forming a square pipe by use of the manufacturing apparatus shown in FIG. 15 and showing a state where the second intermediate formed product is set in a die.

Figure 17:
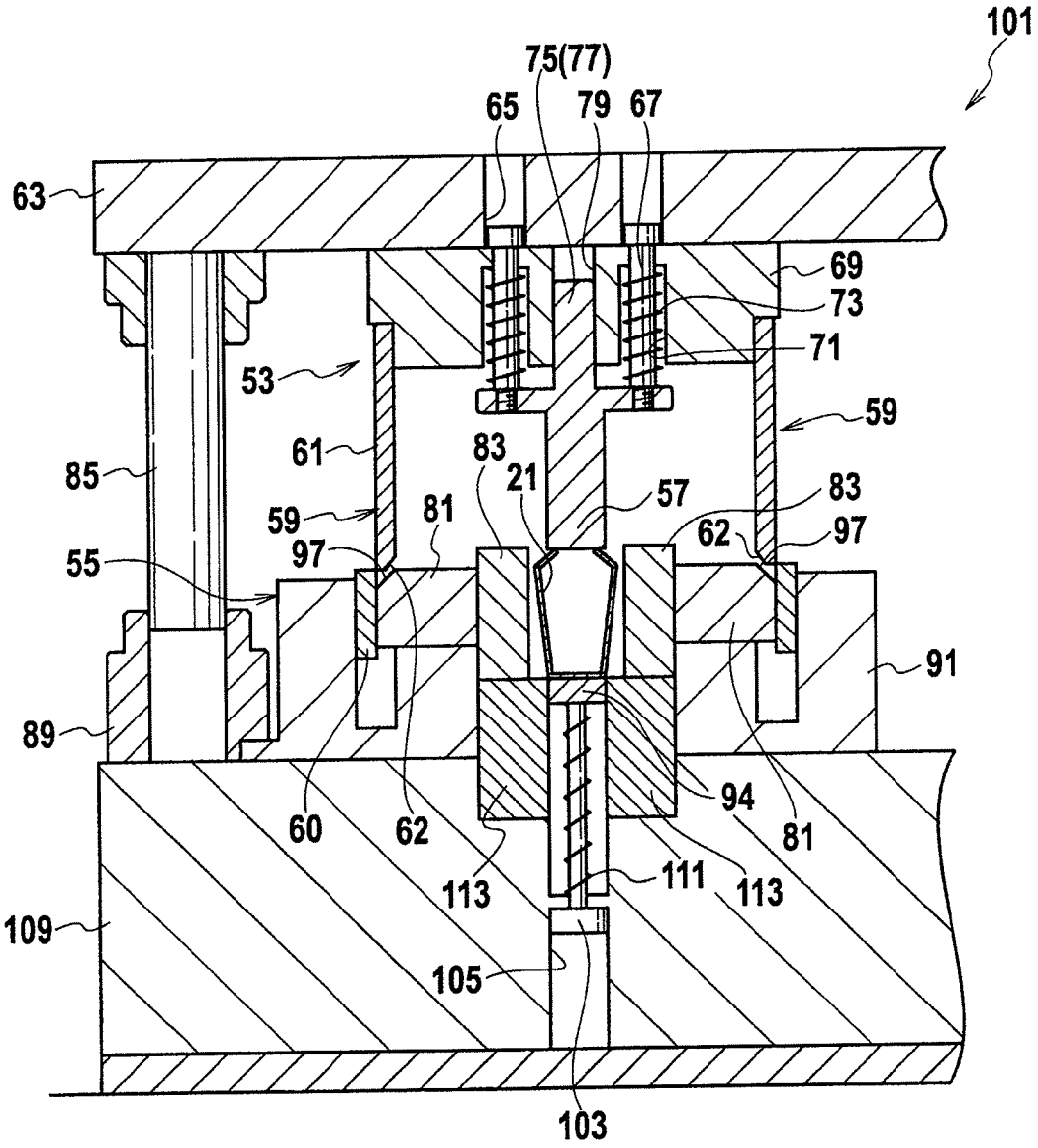

FIG. 17 is a cross-sectional view showing a step of forming the square pipe by use of the manufacturing apparatus shown in FIG. 15 and showing a state where an upper die is lowered and a pressing block presses flange parts of the second intermediate formed product.

Figure 18:
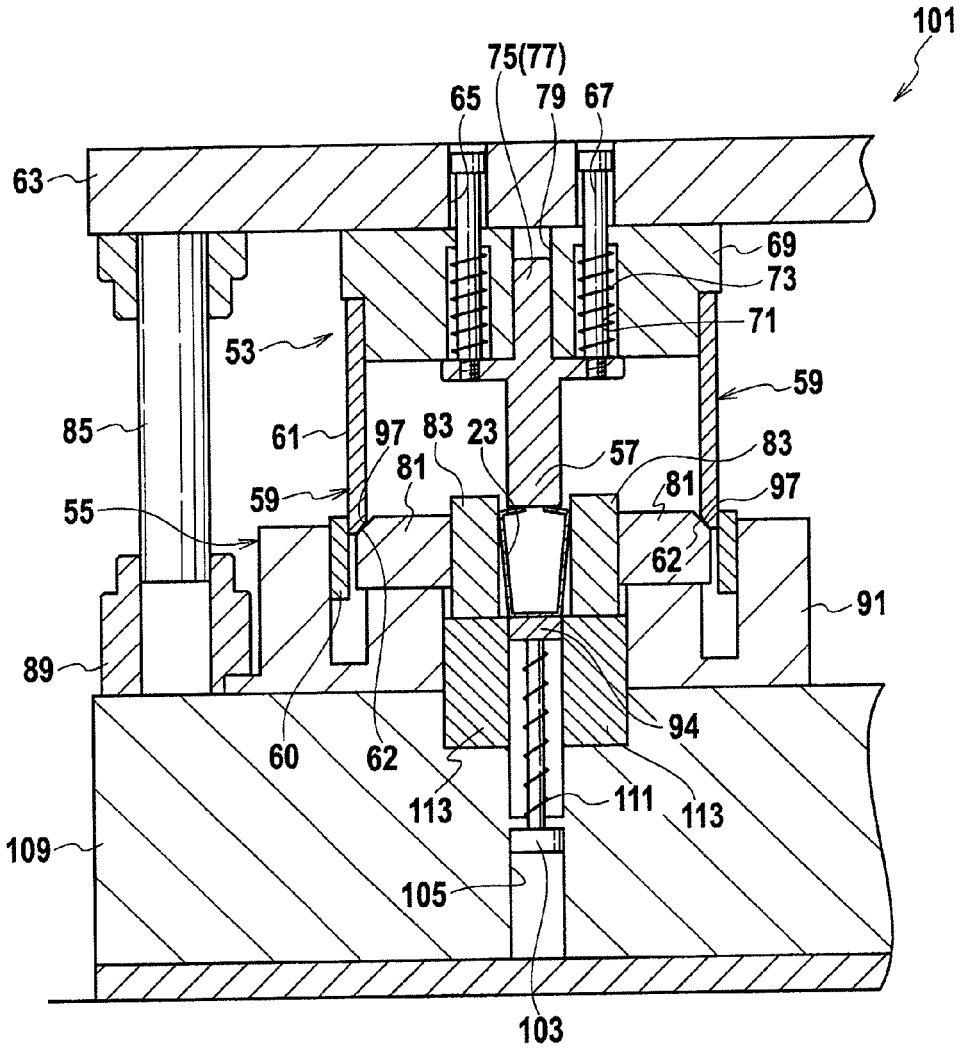

FIG. 18 is a cross-sectional view showing a step of forming the square pipe by use of the manufacturing apparatus shown in FIG. 15 and showing a state where slide cams in a lower die press side wall surfaces of the second intermediate formed product inward in a width direction.

Figure 19:
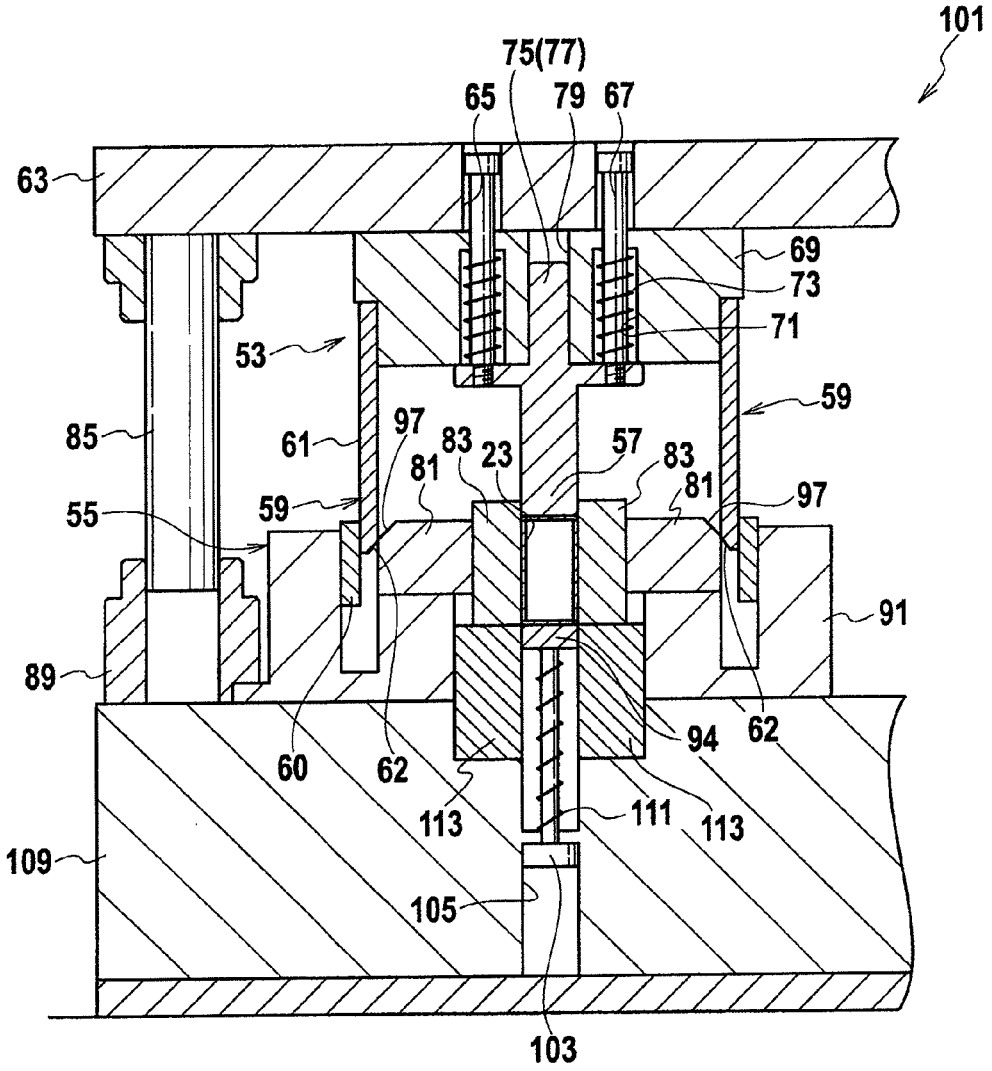

FIG. 19 is a cross-sectional view showing a step of forming the square pipe by use of the manufacturing apparatus shown in FIG. 15 and showing a state where the pressing block in the upper die and the slide cams in the lower die press the flange parts and side wall surfaces of the second intermediate formed product.

Figure 20:
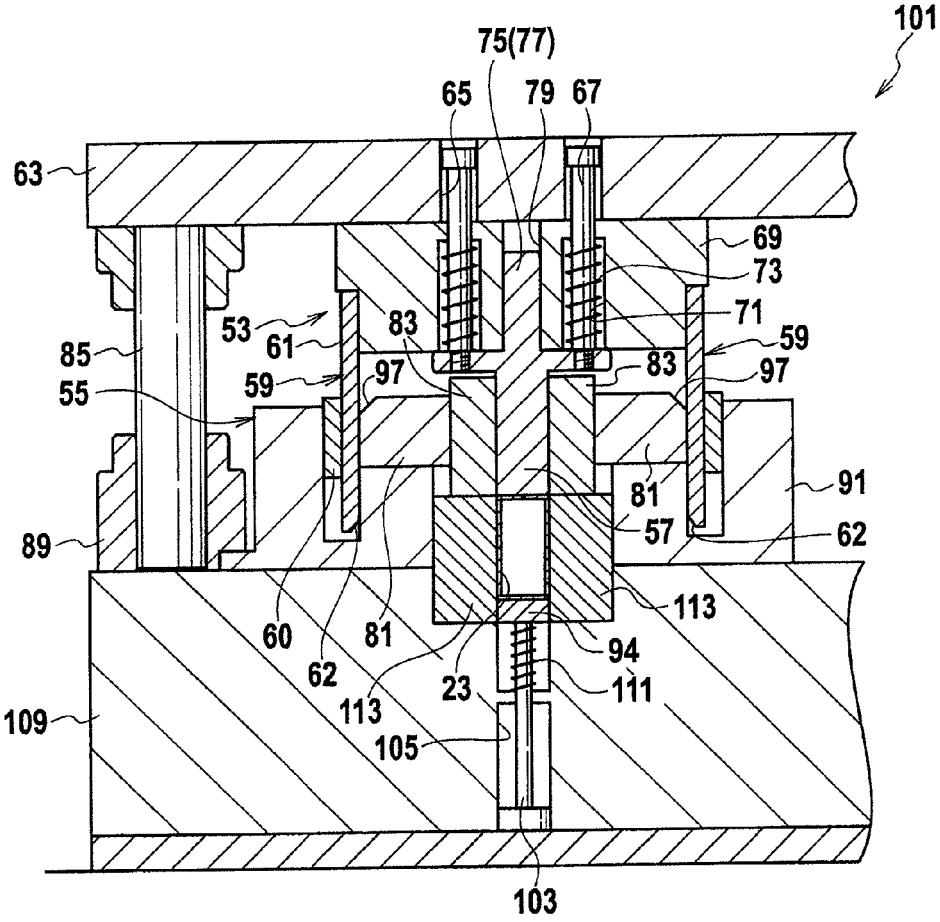

FIG. 20 is a cross-sectional view showing a step of forming the square pipe by use of the manufacturing apparatus shown in FIG. 15 and showing a state where a floating die in the lower die is thrust downward by the pressing block in the upper die.

Figure 21:
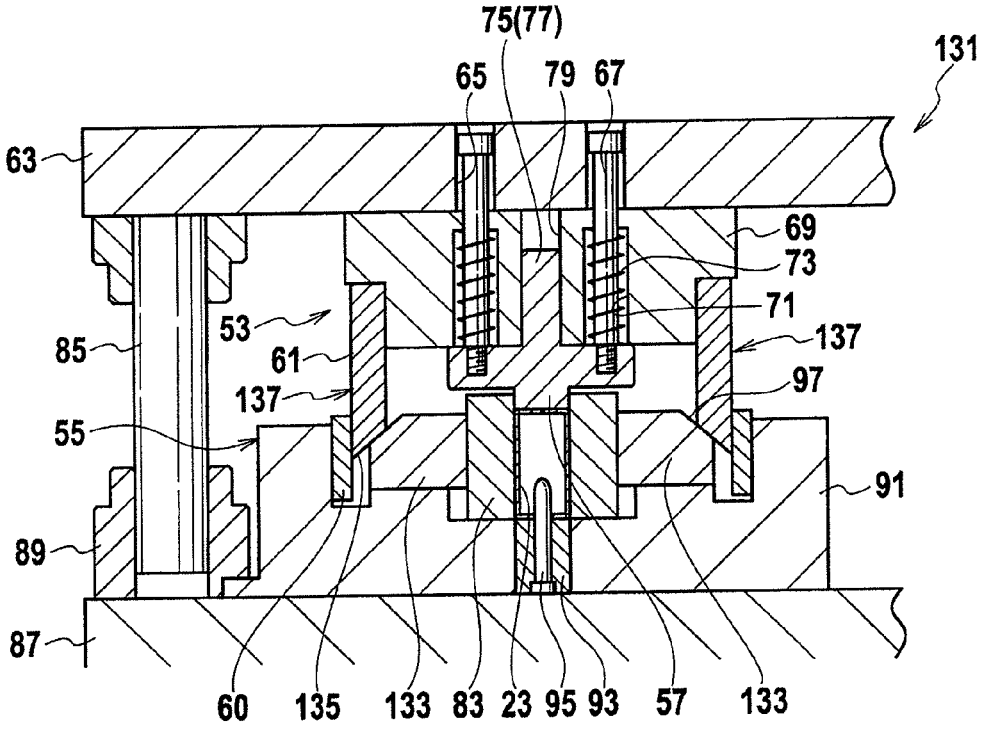

FIG. 21 is a cross-sectional view showing a modified example of the square pipe manufacturing apparatus according to the second embodiment of the present invention.

Figure 22:
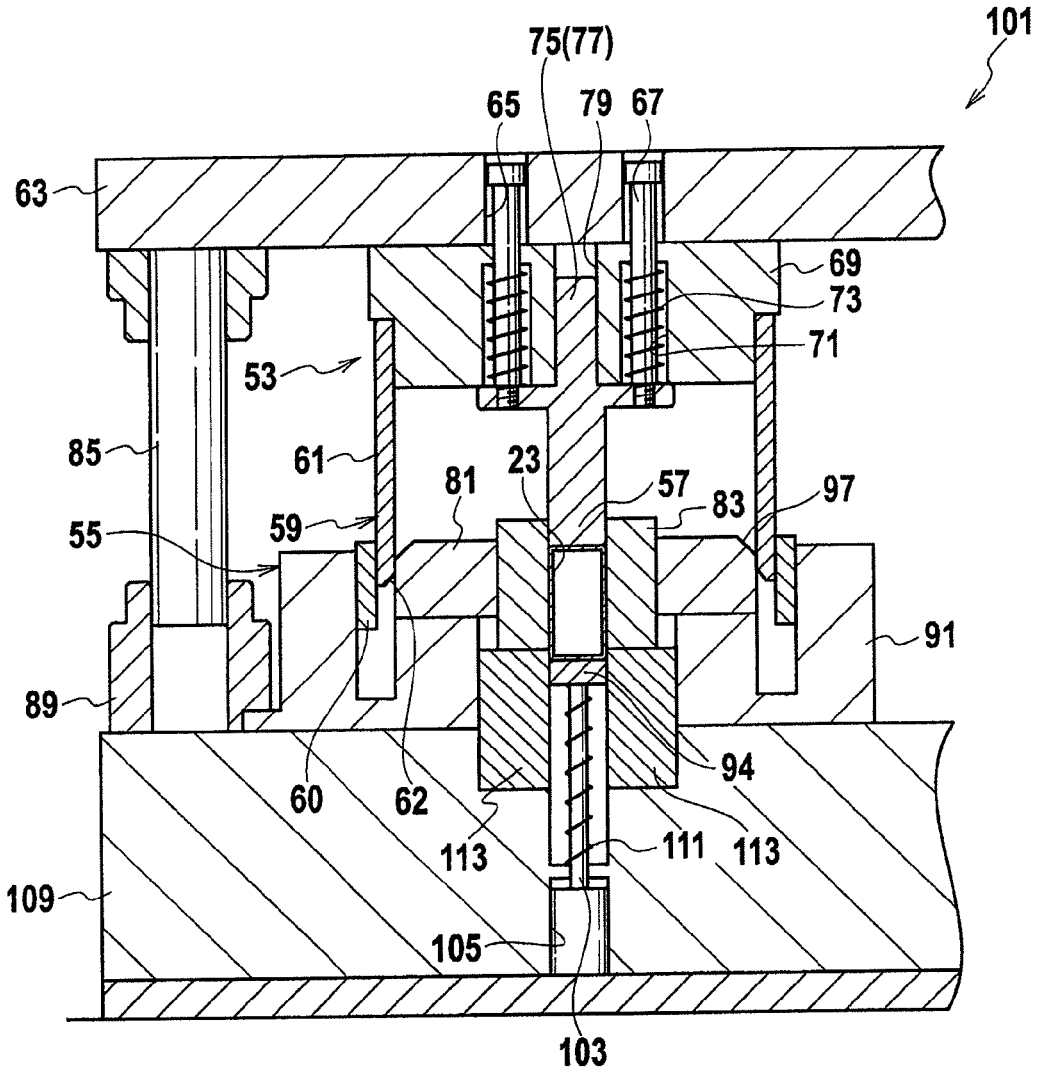

FIG. 22 is a cross-sectional view showing a modified example of the square pipe manufacturing apparatus according to the third embodiment of the present invention.

Figure 23A:
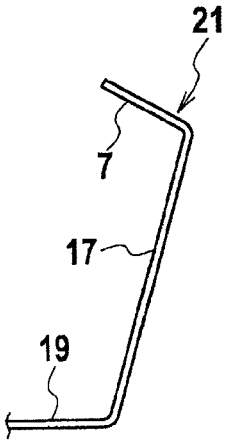
Figure 23B:
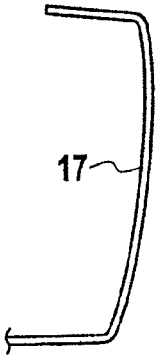
Figure 23C:
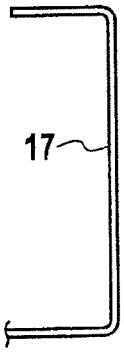
Figure 23D:
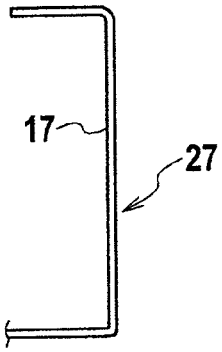

FIGS. 23A through 23D are schematic front views showing a formability simulation of a square pipe forming process according to an example of the present invention among examples, FIG. 23A showing a state where the second intermediate formed product is set, FIG. 23B showing a state where flange parts of the second intermediate formed product are pressed by an upper die, FIG. 23C showing a state where side wall surfaces of the second intermediate formed product are pressed, and FIG. 23D showing a state where corners of the second intermediate formed product are crush-deformed.

Figure 24:
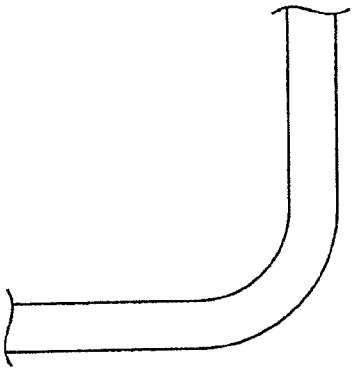

FIG. 24 is an enlarged view of the corner of the bottom wall surface in FIG. 23C.

Figure 25:
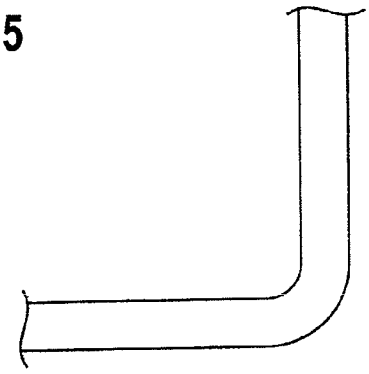

FIG. 25 is an enlarged view of the corner of the bottom wall surface in FIG. 23D.

Figure 26A:
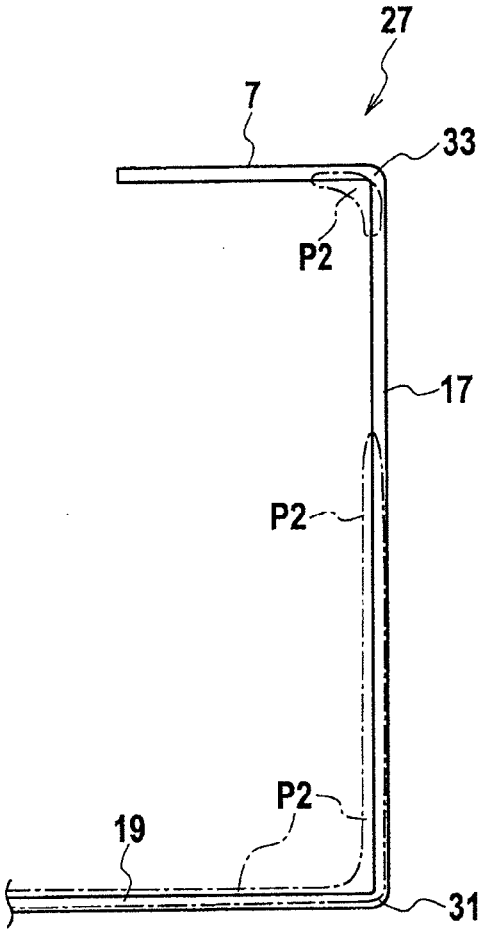
Figure 26B:
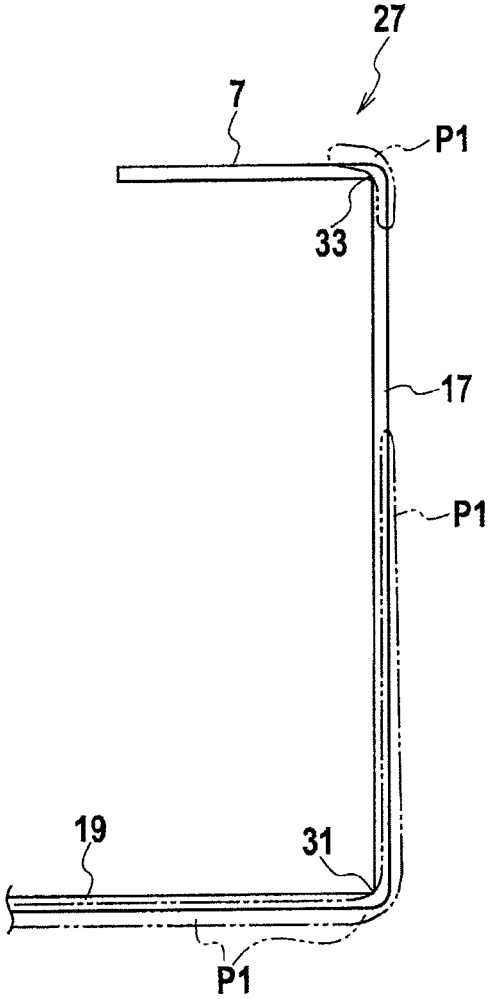

FIGS. 26A and 26B are schematic views showing distributions of stresses in respective portions of the square pipe shown in FIG. 23 when the square pipe is removed from the die, FIG. 26A showing a distribution of stresses in the inner fiber and FIG. 26B showing a distribution of stresses in the outer fiber.

Figures 27A, 27B, 27C, 27D, 27E:
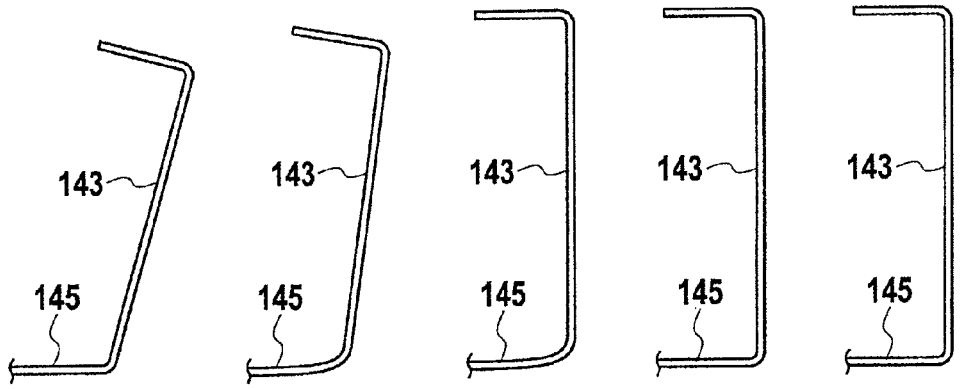

FIGS. 27A through 27E are schematic front views showing a formability simulation of a square pipe forming process according to a comparative example among the examples, FIG. 27A showing a state where an intermediate formed product is set, FIGS. 27B and 27C showing a state where a side wall part of the intermediate formed product is pressed from a side, and FIGS. 27D and 27E showing a state where a top wall surface is pressed downward.

Figure 28A:
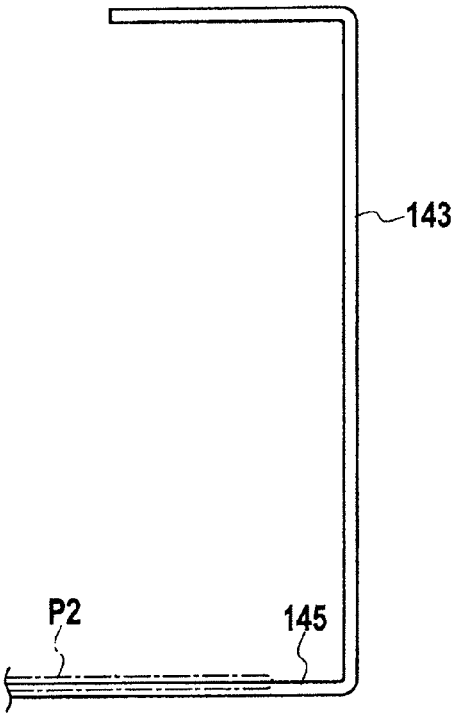
Figure 28B:
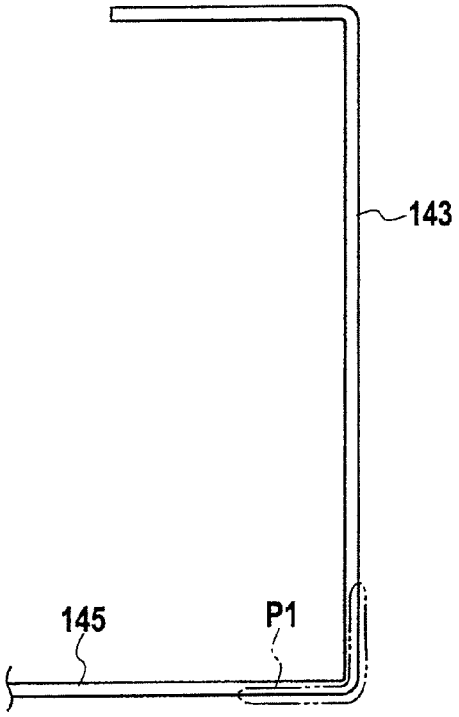

FIGS. 28A and 28B are schematic views showing distributions of stresses in respective portions of the square pipe shown in FIG. 27 when the square pipe is removed from the die, FIG. 28A showing a distribution of stresses in the inner fiber and FIG. 28B showing a distribution of stresses in the outer fiber.

DETAILED DESCRIPTION OF THE PREFERRED EMBODIMENTS

There will be detailed below the preferred embodiments of the present invention with reference to the accompanying drawings. Like members are designated by like reference characters.

First Embodiment

First, description will be given of a square pipe manufacturing method according to a first embodiment of the present invention.

Figure 1:
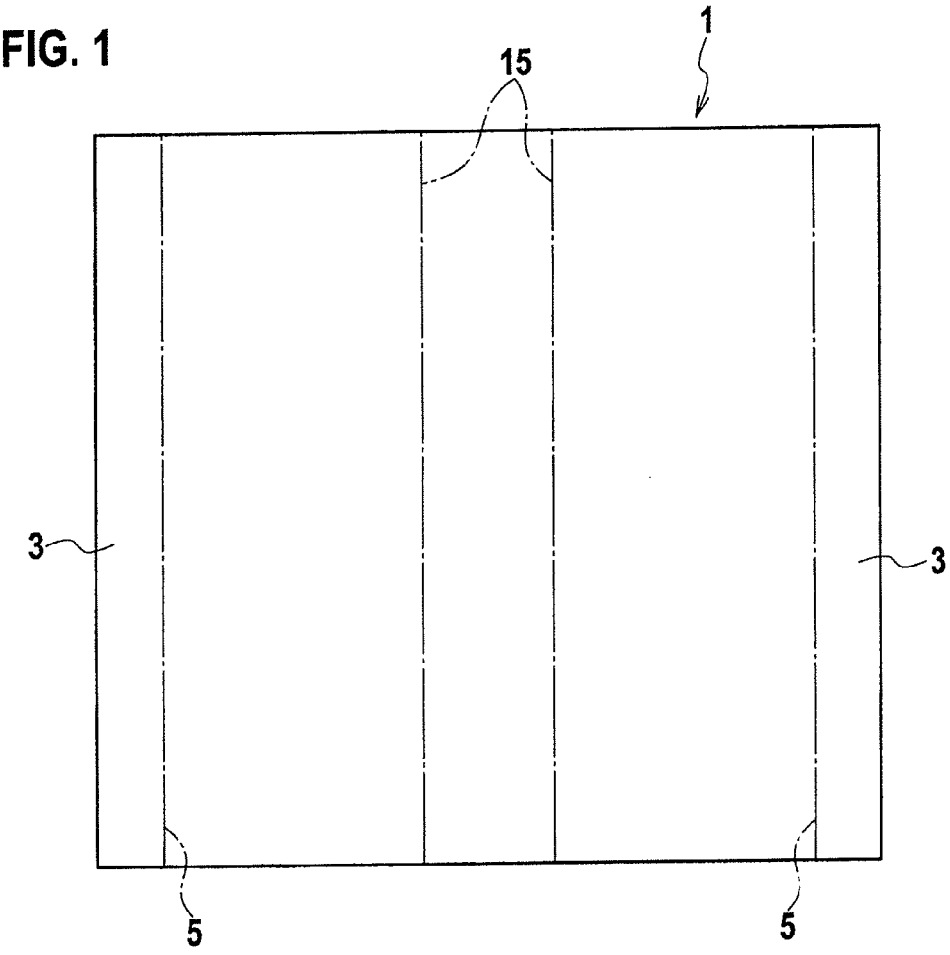
FIG. 1 is a plan view showing a metal plate used in manufacturing a square pipe according to a first embodiment of the present invention.
Figure 2A:
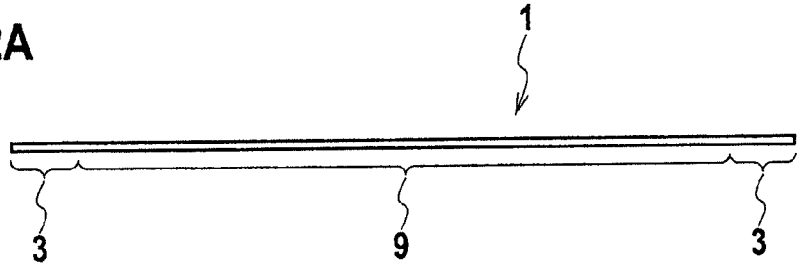
FIGS. 2A and 2B are front views showing a first processing step of forming a first intermediate formed product in steps of manufacturing the square pipe according to the first embodiment of the present invention, FIG. 2A showing a metal plate and FIG. 2B showing the first intermediate formed product.
Figure 2B:
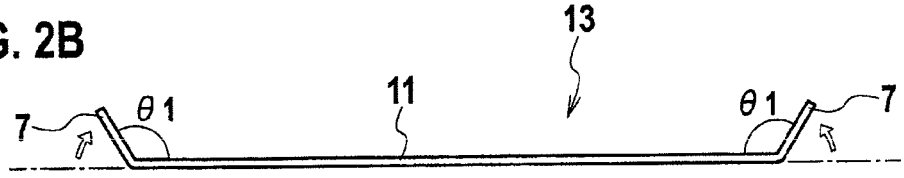
Figure 3A:
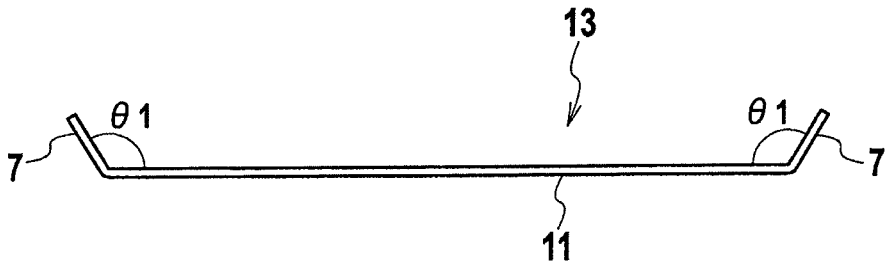
FIGS. 3A and 3B are front views showing a second processing step of forming a second intermediate formed product in the steps of manufacturing the square pipe according to the first embodiment of the present invention, FIG. 3A showing the first intermediate formed product and FIG. 3B showing the second intermediate formed product.
Figure 3B:
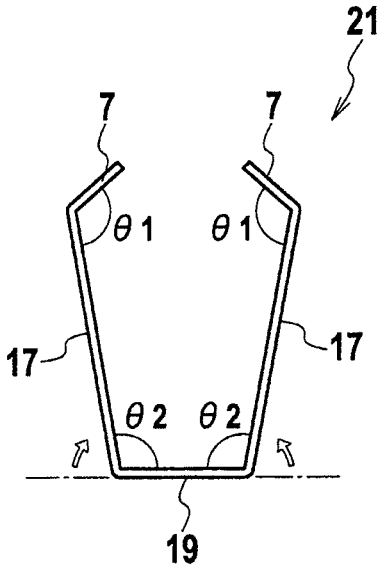

FIG. 1 is a plan view showing a metal plate used in manufacturing a square pipe according to a first embodiment of the present invention. FIGS. 2A and 2B are front views showing a first processing step of forming a first intermediate formed product in steps of manufacturing the square pipe according to the first embodiment of the present invention, FIG. 2A showing a metal plate and FIG. 2B showing the first intermediate formed product. FIGS. 3A and 3B are front views showing a second processing step of forming a second intermediate formed product in the steps of manufacturing the square pipe according to the first embodiment of the present invention, FIG. 3A showing the first intermediate formed product and FIG. 3B showing the second intermediate formed product. FIGS. 4A through 4C are front views showing a third processing step of forming a third intermediate formed product in the steps of manufacturing the square pipe according to the first embodiment of the present invention, FIG. 4A showing the second intermediate formed product, FIG. 4B showing a state where flange parts of the second intermediate formed product are pressed to curve side wall surfaces into convex shapes, and FIG. 4C showing a state where the side wall surfaces curved into the convex shapes are pressed inward in a width direction to form a closed rectangular cross section. FIGS. 5A through 5C are front views showing a fourth processing step of crush-deforming corners in the steps of manufacturing the square pipe according to the first embodiment of the present invention, FIG. 5A showing the third intermediate formed product, FIG. 5B showing a state where corners of the third intermediate formed product are crush-deformed with the application of loads to the corners in a vertical direction, and FIG. 5C showing a state where the corners of the third intermediate formed product are crush-deformed with the application of loads to the corners inward in the width direction.

First, as shown in FIG. 1, a rectangular metal plate 1 to be a material is prepared. The material of the metal plate 1 is not particularly limited. Here, a galvanized steel plate or the like is used. Along a vertical direction on the page space of FIG. 1, first bend lines 5, 5 and second bend lines 15, 15 are set.

Next, as shown in FIGS. 2A and 2B, a first intermediate formed product 13 is formed in a first processing step. Specifically, as shown in FIG. 2B, both end portions 3, 3 (see FIG. 2A) in a width direction of the metal plate 1 are bent at an obtuse angle θ1 along the first bend lines 5, 5 extending in a length direction of the metal plate 1. Thus, the first intermediate formed product 13 is formed, in which the both widthwise end portions 3, 3 are set to be flange parts 7, 7 and a widthwise center portion 9 is set to be a bottom surface 11. The angle θ1 is preferably 100 degrees to 110 degrees, but is appropriately changed according to dimensions of a finished product.

Thereafter, as shown in FIGS. 3A and 3B, a second intermediate formed product 21 is formed in a second processing step. Specifically, as shown in FIGS. 3A and 3B, both widthwise sides of the bottom surface 11 of the first intermediate formed product 13 are bent at an obtuse angle θ2 relative to a widthwise center portion of the bottom surface 11 along the second bend lines 15, 15 extending in a length direction of the bottom surface 11. Thus, the second intermediate formed product 21 is formed, in which the both widthwise sides of the bottom surface 11 are set to be side wall surfaces 17, 17 and the widthwise center portion of the bottom surface 11 is set to be a bottom wall surface 19. Also in this case, the angle θ2 is preferably 100 degrees to 110 degrees, but is appropriately changed according to the dimensions of the finished product.

Next, as shown in FIGS. 4A through 4C, a third intermediate formed product 23 is formed in a third processing step. Specifically, as shown in FIGS. 4A and 4B, the flange parts 7, 7 in the second intermediate formed product 21 are pressed toward the bottom wall surface 19, thereby curving the side wall surfaces 17, 17 to be convex outward in the width direction. This is done to press the flange parts 7, 7 downward when a pressing block to be described later comes into contact with the widthwise inner end portions because the flange parts 7, 7 extend obliquely upward toward a widthwise inner side and widthwise inner end portions of the flange parts 7, 7 are arranged above widthwise outer end portions.

Thereafter, as shown in FIG. 4C, the curved side wall surfaces 17, 17 are pressed inward in the width direction, thereby causing the flange parts 7, 7 to butt against each other. Thus, the third intermediate formed product 23 having a closed rectangular cross section is obtained.

Subsequently, as shown in FIGS. 5A through 5C, a square pipe 27 to be a final finished product is formed in a fourth processing step. Specifically, as shown in FIG. 5B, corners 31, 31, 33, 33 of the third intermediate formed product 23 are crush-deformed by compressing the flange parts 7, 7 in the third intermediate formed product 23 toward the bottom wall surface 19 arranged opposite to the flange parts 7, 7 and by compressing the bottom wall surface 19 toward the flange parts 7, 7 so that the flange parts 7, 7 and the bottom wall surface 19 are relatively approached each other. Herein, "crush deformation" means plastic deformation for reducing a curvature R of the corners 31, 33 (from a curvature status as shown in FIG. 24 into another curvature status as shown in FIG. 25) by applying loads to the corners 31, 33 in an up-and-down direction (vertical direction) and/or in the width direction (lateral direction). In other words, the "crush deformation" and "being crush-deformed" mean a kind of sheet metal working operations by plastic deformation, and being similar to a coining operation at a bending operation of the sheet metal working operations. Note that, as shown in FIGS. 2 through 5, the bottom surface 11 of the first intermediate formed product 13 and the bottom wall surface 19 of the second and third intermediate formed products 21 and 23 are formed in an approximately planar shape without being curved in the vertical direction.

Moreover, as shown in FIG. 5C, the corners 31, 31, 33, 33 of the third intermediate formed product 23 may also be crush-deformed by compressing the flange parts 7, 7 and the bottom wall surface 19 inward in the width direction.

Next, description will be given of the square pipe and a frame structure using the square pipes according to the first embodiment of the present invention.

FIG. 6 is a perspective view showing the square pipe according to the first embodiment of the present invention. FIG. 7A is a front view schematically showing residual stresses in the square pipe according to the first embodiment of the present invention, FIG. 7B is a front view schematically showing, in the case where the flange part on one side is removed, movement of the side wall surface on the other side, and FIG. 7C is a front view schematically showing, in the case where the flange part on one side exists, stresses of the flange parts on one side and the other side pushing against each other. FIG. 8 is a perspective view showing a frame structure using the square pipes according to the first embodiment of the present invention.

As shown in FIGS. 6 and 7, the metal square pipe 27 according to the first embodiment of the present invention is formed to have an approximately rectangular closed cross section. The square pipe 27 includes: the bottom wall surface 19; a pair of the side wall surfaces 17, 17 extending from both widthwise ends of the bottom wall surface 19 approximately at right angles relative to the bottom wall surface 19; and a top wall surface 29 formed by bringing a pair of the flange parts 7, 7 into close contact with each other, the flange parts extending from tips of the side wall surfaces 17, 17 inward in the width direction approximately at right angles relative to the respective side wall surfaces 17, 17. Moreover, as shown in FIG. 6, a joining part 35 of the flange parts 7, 7 are bonded to each other by arc welding, and a plurality of arc welded parts 37 are provided at predetermined intervals along a longitudinal direction.

As shown in FIG. 7A, residual stresses P1 and P2 act on the lower corners 31, 31 where the bottom wall surface 19 and the side wall surfaces 17, 17 intersect with each other and on the upper corners 33, 33 where the side wall surfaces 17, 17 and the top wall surface 29 intersect with each other. Specifically, the residual stresses P1 and P2 bring end edges 7*a*, 7*a* of the pair of flange parts 7, 7 into close contact with each other. To be more specific, at each of the lower corners 31, 31, a tensile stress P1 acts on an outer side thereof and a compressive stress P2 acts on an inner side thereof. Similarly, at each of the upper corners 33, 33, a tensile stress P1 acts on an outer side thereof and a compressive stress P2 acts on an inner side thereof.

Therefore, as shown in FIG. 7B, if one of the pair of flange parts 7, 7 is removed, the other flange part 7 falls inward in the width direction. For this reason, as shown in FIG. 7C, the end edges 7*a*, 7*a* of the both flange parts 7, 7 are pressed against each other to surely come into close contact with each other.

Moreover, a frame structure 39 according to this embodiment is generally formed in an approximately box shape and configured by assembling a plurality of steel square pipes manufactured by the same forming method as that of the square pipe 27 described above. As shown in FIG. 8, in the frame structure 39, a total of four vertically extending leg parts 41, 41, 41, 41 are arranged at corners. Moreover, upper ends of the leg parts 41, 41, 41, 41 are connected by four connecting members 43, 44, 45, 45 which are arranged approximately horizontally, and lower ends of the leg parts 41, 41, 41, 41 are connected by four connecting members 43, 44, 45, 45 which are arranged approximately horizontally. Furthermore, reinforcing members 47, 47, 49, 49, 49, 49 are arranged in the middle of a height direction. For the leg parts 41, 41, 41, 41, the connecting members 43, 44, 45, and the reinforcing members 47, 47, 49, 49, 49, 49, the square pipes according to this embodiment are used.

Advantages and effects (operations and results) achieved by the first embodiment will be described below.

(1) The square pipe manufacturing method according to this embodiment includes: a first processing step of forming a first intermediate formed product 13 by bending both widthwise end portions 3, 3 of a rectangular metal plate 1 along first bend lines 5, 5 each extending in a length direction of the metal plate 1, the first intermediate formed product 13 having the both widthwise end portions 3, 3 as flange parts 7, 7 and a widthwise center portion as a bottom surface 11; a second processing step of forming a second intermediate formed product 21 by bending each of both widthwise sides of the bottom surface 11 of the first intermediate formed product 13 at an obtuse angle θ2 relative to a widthwise center portion of the bottom surface 11 along each of second bend lines 15, 15 extending in a length direction of the bottom surface 11, the second intermediate formed product 21 having the both widthwise sides of the bottom surface 11 as side wall surfaces 17, 17 and the widthwise center portion of the bottom surface 11 as a bottom wall surface 19; a third processing step of obtaining a third intermediate formed product 23 formed to have a closed rectangular cross section by allowing the flange parts 7, 7 in the second intermediate formed product 21 to butt against each other; and a fourth processing step of crush-deforming corners 31, 31, 33, 33 of the third intermediate formed product 23 and generating residual stresses on the corners 31, 31, 33, 33 by the crush-deformation, the corners crush-deformed by compressing the flange parts 7, 7 and the bottom wall surface 19 arranged opposite to the flange parts 7, 7 in the third intermediate formed product 23 in a direction of bringing the flange parts 7, 7 and the bottom wall surface 19 relatively close to each other, the residual stresses bringing the pair of flange parts 7, 7 into close contact with each other.

As described above, the pair of flange parts 7, 7 are brought into close contact with each other by action of the residual stresses generated by crush-deforming the corners 31, 31, 33, 33. Accordingly, the flange parts 7, 7 in the square pipe according to this embodiment are more firmly pressed against each other and evenly come into contact with each other than the case where the residual stresses are caused to act on the bottom wall surface 19. Thus, the rectangular cross section can be securely obtained. Specifically, when the residual stresses are caused to act on the bottom wall surface 19, the bottom wall surface 19 is likely to be curved into a convex or concave shape even though only slightly. Therefore, it is difficult to obtain the rectangular cross section. However, when the residual stresses are caused to act not on the bottom wall surface 19 but on the corners 31, 31, 33, 33 as in the case of the present invention, the bottom wall surface 19 is less likely to be curved into the convex or concave shape. Thus, the rectangular cross section can be securely maintained.

(2) In the third processing step, the flange parts 7, 7 in the second intermediate formed product 21 are pressed toward the bottom wall surface 19 so that the side wall surfaces 17, 17 are curved to be convex outward in the width direction. Thereafter, the curved side wall surfaces 17, 17 are pressed inward in the width direction, thereby allowing the flange parts 7, 7 to butt against each other. Thus, the third intermediate formed product 23 having a closed rectangular cross section is obtained.

As described above, in this embodiment, the residual stresses are also generated on the side wall surfaces 17, 17 in addition to the corners 31, 31, 33, 33. Thus, the flange parts 7, 7 are even more firmly pressed against each other to firmly come into close contact with each other.

(3) Moreover, in this embodiment, the flange parts 7, 7 are formed in the first processing step by bending each of the both widthwise end portions 3, 3 of the metal plate 1 at an obtuse angle θ1 relative to the widthwise center portion. Thus, the side wall surfaces 17, 17 in the second intermediate formed product 21 are more easily curved to be convex outward in the width direction.

(4) In this embodiment, the flange parts 7, 7 in the second intermediate formed product 21 are pressed toward the bottom wall surface 19 and then pressed inward in the width direction. In this case, the second intermediate formed product 21 is first restrained in the vertical direction and thus the bottom wall surface 19 is not curved into a convex shape. Accordingly, the third intermediate formed product 23 is not lifted up. Thus, variation in positions of the intermediate formed products 21 and 23 during forming thereof is reduced. As a result, the square pipe 27 with stable quality can be obtained.

(5) The square pipe according to this embodiment is the metal square pipe 27 formed to have an approximately rectangular closed cross section. The square pipe 27 includes: the bottom wall surface 19; a pair of side wall surfaces 17, 17 extending approximately at right angles to the bottom wall surface 19 from both widthwise ends of the bottom wall surface 19; and a top wall surface 29 formed of a pair of flange parts 7, 7 brought into close contact with each other, the flange parts extending from tips of the side wall surfaces 17, 17 inward in the width direction approximately at right angles to the side wall surfaces 17, 17. The residual stresses, that bring the pair of flange parts 7, 7 into close contact with each other, act on at least any of the lower corners 31 and 31 where the bottom wall surface 19 and the side wall surfaces 17, 17 intersect with each other and the upper corners 33, 33 where the side wall surfaces 17, 17 and the top wall surface 29 intersect with each other. As described above, the pair of flange parts 7, 7 are brought into close contact with each other by action of the residual stresses on the corners 31, 31, 33, 33. Accordingly, compared with the case where the residual stresses are caused to act on the only bottom wall surface 19, the rectangular cross section can be more securely maintained. Specifically, when the residual stresses are caused to act on the bottom wall surface 19, the bottom wall surface 19 is curved into a convex or concave shape even with a slight amount. Therefore, it is difficult to obtain the rectangular cross section. However, when the residual stresses are caused to act not on the bottom wall surface 19 but on the corners 31, 31, 33, 33 as in the case of the present invention, the bottom wall surface 19 is less likely to be curved into the convex or concave shape. Thus, the rectangular cross section can be securely maintained. Note that, when the residual stresses are caused to act on the side wall surfaces 17, 17 in addition to the corners 31, 31, 33, 33, the flange parts 7, 7 are even more firmly pressed against each other to firmly come into close contact with each other.

(6) In the square pipe 27 according to this embodiment and the frame structure 39 including the square pipes 27 as its constituent components, residual stresses, that bring the pair of flange parts 7, 7 into close contact with each other, act on the side wall surfaces 17, 17. Thus, as described above, the rectangular cross section can be securely maintained.

Second Embodiment

Next, a second embodiment of the present invention will be described. Parts having the same structure as those in the first embodiment are denoted by the same reference numerals, and description thereof will be omitted.

FIG. 9 is a cross-sectional view showing a square pipe manufacturing apparatus according to the second embodiment of the present invention. FIG. 10 is a cross-sectional view showing a step of forming a square pipe by use of the manufacturing apparatus shown in FIG. 9 and showing a state where the second intermediate formed product is set in a die. FIG. 11 is a cross-sectional view showing a step of forming the square pipe by use of the manufacturing apparatus shown in FIG. 9 and showing a state where an upper die is lowered and a pressing block presses flange parts of the second intermediate formed product. FIG. 12 is a cross-sectional view showing a step of forming the square pipe by use of the manufacturing apparatus shown in FIG. 9 and showing a state where slide cams in a lower die press side wall surfaces of the second intermediate formed product inward in a width direction. FIG. 13 is a cross-sectional view showing a step of forming the square pipe by use of the manufacturing apparatus shown in FIG. 9 and showing a state where the pressing block in the upper die and the slide cams in the lower die press the flange parts and side wall surfaces of the second intermediate formed product. FIG. 14 is a cross-sectional view showing a forming method according to a modified example of the second embodiment and showing a state where the second intermediate formed product is set in a die upside down with respect to FIG. 10.

As shown in FIG. 9, a square pipe manufacturing apparatus 51 according to this embodiment has a die, including an upper die 53 and a lower die 55, for forming a square pipe 27 including a plurality of wall surfaces and having a rectangular cross section by use of the second intermediate formed product 21, the second intermediate formed product 21 formed by bending a rectangular metal plate 1 along a plurality of bend lines extending in a length direction thereof, the second intermediate formed product 21 including a bottom wall surface 19, side wall surfaces 17, 17 obtained by bending both widthwise sides of the bottom wall surface 19 at an obtuse angle, and flange parts 7, 7 obtained by bending tip portions of the side wall surfaces 17, 17.

The upper die 53 includes: a pressing block 57 provided so as to be vertically movable in a state of being biased downward and configured to deform the flange parts 7, 7 of the set second intermediate formed product 21 by pressing the flange parts 7, 7 downward and then to crush-deform corners 31, 31, 33, 33 of a third intermediate formed product 23 by compressing the flange parts 7, 7 downward; main body parts 61, 61 each having an approximately uniform thickness and extending downward; and driver cams 59, 59 each including a slope part 62 formed at a lower end of the main body part 61.

Moreover, an upper die plate 63 is vertically penetrated by insertion holes 65, 65 and mounting bolts 67, 67 are inserted into the insertion holes 65, 65. The mounting bolts 67, 67 have their tip portions screwed and fixed to an upper die punch 75. Through-holes 71, 71 are formed in an upper die holder 69, and springs 73, 73 are installed in the through-holes 71, 71 in a compressed and biased state. Moreover, above the upper die punch 75 having the pressing block 57, a guide part 77 is provided so as to protrude upward. The guide part 77 is slidably inserted into an insertion hole 79 in the upper die holder 69. Furthermore, on the upper die plate 63, a guide pin 85 is provided so as to protrude downward. The guide pin 85 is arranged so as to be engageable with a guide bush 89 provided on a lower die plate 87.

On the other hand, the lower die 55 includes a pair of left and right side punches 83 and 83 and slide cams 81 and 81, which are configured to be slidable in a horizontal direction by engagement with the slope parts 62, 62 of the driver cams 59, 59 and to plastically deform the side wall surfaces 17, 17 into a planar shape by pressing the side wall surfaces from both sides, the side wall surfaces 17, 17 being curved to be convex outward in the width direction by pressing the flange parts 7, 7 of the second intermediate formed product 21 downward by the pressing block 57. The pressing block 57 in the upper die 53 is configured to press the second intermediate formed product 21 before the side punches 83, 83 in the lower die 55 does, to slidably move the slide cams 81, 81 inward in the width direction when the driver cams 59, 59 are lowered and the slope parts 62, 62 are engaged with slope parts 97, 97 of the slide cams 81, 81 in the lower die 55, and to stop the slide movement of the slide cams 81, 81 when a lowered height of the upper die 53 reaches a predetermined height or more. Note that slide plates 60, 60 are provided in a lower die holder 91 so as to support the driver cams 59, 59 on its back so that the slide plates 60 are not deformed outward.

Here, in this embodiment, the side punches 83, 83 are mounted on the widthwise inside of the slide cams 81, 81, and the slide cams 81 and the side punches 83, 83 are integrally and slidably moved in the horizontal direction. However, the side punches 83, 83 may be eliminated and the side wall surfaces 17, 17 of the intermediate formed product 21 or 23 may be pressed only by the slide cams 81, 81. Furthermore, in a widthwise center portion of the lower die holder 91, a lower die punch 93 is provided and a locating pin 95 vertically penetrating the lower die punch 93 is provided.

Note that surfaces of the pressing block 57, side punches 83, 83 and lower die punch 93 coming into contact with the intermediate formed products 21 and 23 are flat.

Next, with reference to FIGS. 10 through 13, description will be given of steps of operating the manufacturing apparatus 51.

First, as shown in FIG. 10, the second intermediate formed product 21 is set in the die. When the upper die 53 is lowered, as shown in FIG. 11, in this state, the pressing block 57 comes into contact with the flange parts 7, 7 of the second intermediate formed product 21 and then the slope parts 62, 62 of the driver cams 59, 59 come into contact with the slope parts 97,97 of the slide cams 81, 81. As shown in FIGS. 12 and 13, when the upper die 53 is further lowered, the driver cams 59, 59 causes the slide cams 81, 81 to slide inward and the side punches 83, 83 press the side wall surfaces 17, 17 of the second intermediate formed product 21 inward in the width direction. At the stage of FIG. 13, the third intermediate formed product 23 is vertically pressed by the pressing block 57 and the sides of the third intermediate formed product 23 are pressed by the side punches 83, 83. Accordingly, the corners 31, 31, 33, 33 of the third intermediate formed product 23 are crushed and residual stresses causing the flange parts 7, 7 to fall inward in the width direction are generated.

Moreover, in FIGS. 10 through 13, the operation is made while the intermediate formed products 21 and 23 each are in a posture having the flange parts 7, 7 at the top and the bottom wall surface 19 at the bottom. However, the present invention is not limited thereto, but the intermediate formed products 21 and 23 may be turned upside down as shown in FIG. 14. Specifically, processing is performed with both widthwise end portions directed downward in the first processing step, with both widthwise sides of the bottom surface 11 directed downward in the second processing step, and with the bottom wall surface 19 positioned at the top in the third and fourth processing steps. In this case, a distance between end portions of the flange parts 7, 7 is larger than a distance of the bottom wall surface 19. Thus, each of the intermediate formed products 21 and 23 is set in a stable posture when set in the die.

Advantages and effects (operations and results) achieved by the second embodiment will be described below.

(1) In this embodiment, the following manufacturing method can be adopted. Specifically, as described with reference to FIG. 14, processing is performed with the intermediate formed products 21 and 23 set upside down, with the both widthwise end portions 3, 3 of the metal plate 1 directed downward in the first processing step, with both widthwise sides of the bottom surface 11 directed downward and then bent in the second processing step, and with the bottom wall surface 19 positioned at the top in the third and fourth processing steps. According to this manufacturing method, the bottom surface 11 and the bottom wall surface 19 of the intermediate formed products 21 and 23 are arranged at the top. Thus, an effect that the intermediate formed products 21 and 23 are easily transferred by a transfer device such as a vacuum cup is obtained.

(2) The square pipe manufacturing apparatus according to this embodiment is a square pipe manufacturing apparatus 51, including a upper die 53 and a lower die 55, for forming a square pipe 27 including a plurality of wall surfaces and having a rectangular cross section by use of intermediate formed products 21 and 23 obtained by bending a rectangular metal plate 1 along a plurality of bend lines 5, 5, 15, 15 each extending in a length direction of the metal plate 1, the intermediate formed product including a bottom wall surface 19, side wall surfaces 17, 17 obtained by bending both widthwise sides of the bottom wall surface 19, and flange parts 7, 7 obtained by bending tip portions of the side wall surfaces 17, 17. The upper die 53 includes: a pressing block 57 provided so as to be vertically movable in a state of being biased downward and configured to deform the flange parts 7, 7 of each of the set intermediate formed products 21 and 23 by pressing the flange parts 7, 7 downward and to crush-deform corners 31, 31, 33, 33 of each of the intermediate formed products 21 and 23 by compressing the flange parts 7, 7 downward; and driver cams 59, 59 each including a main body part 61 having an approximately uniform thickness and extending downward and a slope part 62 formed at a lower end of the main body part 61. The lower die 55 includes a pair of left and right slide cams 81 and 81 configured to be slidable in a horizontal direction by engagement with the slope parts 62, 62 of the driver cams 59, 59 and to deform the side wall surfaces 17, 17 into a flat surface by pressing the side wall surfaces 17, 17 from both sides, the side wall surfaces 17, 17 being curved to be convex outward in the width direction by pressing the flange parts 7, 7 of the intermediate formed product 21 downward by the pressing block 57. The pressing block 57 in the upper die 53 is configured to press the intermediate formed product 21 before the slide cams 81 and 81 in the lower die 55 do, to slidably move the slide cams 81 and 81 inward in the width direction when the driver cams 59, 59 are lowered and the slope parts 62, 62 are engaged with the slide cams 81, 81 in the lower die 55, and to stop the slide movement of the slide cams 81, 81 when a lowered height of the upper die 53 reaches a predetermined height or more.

Therefore, even when the upper die 53 is lowered too much, the side wall surfaces 17, 17 of the intermediate formed products 21 and 23 can be crush-deformed with a proper pressing force without being pressed too much.

Third Embodiment

Next, a third embodiment of the present invention will be described. Parts having the same configurations as those in the first and second embodiments are denoted by the same reference numerals, and description thereof will be omitted.

FIG. 15 is a cross-sectional view showing a square pipe manufacturing apparatus according to a third embodiment of the present invention. FIG. 16 is a cross-sectional view showing a step of forming a square pipe by use of the manufacturing apparatus shown in FIG. 15 and showing a state where the second intermediate formed product 21 is set in a die. FIG. 17 is a cross-sectional view showing a step of forming the square pipe by use of the manufacturing apparatus shown in FIG. 15 and showing a state where an upper die is lowered and a pressing block presses flange parts of the second intermediate formed product. FIG. 18 is a cross-sectional view showing a step of forming the square pipe by use of the manufacturing apparatus shown in FIG. 15 and showing a state where a slide cams in a lower die press side wall surfaces of the second intermediate formed product inward in a width direction. FIG. 19 is a cross-sectional view showing a step of forming the square pipe by use of the manufacturing apparatus shown in FIG. 15 and showing a state where the pressing block in the upper die and the slide cams in the lower die press the flange parts and side wall surfaces of the second intermediate formed product. FIG. 20 is a cross-sectional view showing a step of forming the square pipe by use of the manufacturing apparatus shown in FIG. 15 and showing a state where a floating die in the lower die is thrust downward by the pressing block in the upper die. FIG. 21 is a cross-sectional view showing a modified example of the square pipe manufacturing apparatus according to the second embodiment of the present invention. FIG. 22 is a cross-sectional view showing a modified example of the square pipe manufacturing apparatus according to the third embodiment of the present invention.

As shown in FIG. 15, a square pipe manufacturing apparatus 101 according to the third embodiment has basically the same structure as that of the manufacturing apparatus 51 shown in FIG. 9. However, the square pipe manufacturing apparatus 101 is different from the manufacturing apparatus 51 in that a die cushion mechanism is provided in a lower die plate 109. Only differences from the manufacturing apparatus 51 will be described below.

In the lower die plate 109, a cushion pad 94 is provided, which supports the intermediate formed product 23 from below. On both left and right sides of the cushion pad 94, lower die inserts 113 and 113 are provided. Moreover, a mounting bolt 103 attached to the cushion pad 94 is configured to be vertically movable within an insertion hole 105. Moreover, the cushion pad 94 is biased upward by a spring 111 wound around the mounting bolt 103. When the cushion pad 94 is pressed downward, the spring 111 is compressed to generate an up lifting force. This die cushion mechanism makes it possible to plastically press the intermediate formed product 23 from above and below.

Next, with reference to FIGS. 16 through 20, description will be given of steps of operating the manufacturing apparatus 101.

First, as shown in FIG. 16, the second intermediate formed product 21 is set in the die 101. When the upper die 53 is lowered, as shown in FIG. 17, in this state, the pressing block 57 comes into contact with the flange parts 7, 7 of the second intermediate formed product 21 and then the slope parts 62, 62 of the driver cams 59, 59 come into contact with the slope parts 97, 97 of the slide cams 81, 81. As shown in FIGS. 18 and 19, when the upper die 53 is further lowered, the driver cams 59, 59 causes the slide cams 81, 81 to slide inward and the side punches 83, 83 press the side wall surfaces 17, 17 of the second intermediate formed product 21 inward in the width direction. Thereafter, as shown in FIG. 20, when the third intermediate formed product 23 is further pressed downward, the cushion pad 94 sinks and the third intermediate formed product 23 is pressed from above and below by the pressing block 57 and the cushion pad 94. Accordingly, the third intermediate formed product 23 is plastically pressed from above and below to crush the corners 31, 31, 33, 33 of the third intermediate formed product 23. As a result, residual stresses causing the flange parts 7, 7 to fall inward in the width direction are generated.

Moreover, the manufacturing apparatus of the present invention can perform crush deformation shown in FIG. 5C. Note that, in a manufacturing apparatus 131 shown in FIG. 21, slide cams 133, 133 are caused to slide inward in the width direction of the intermediate formed product 23 along with lowering of driver cams 137, 137. However, unlike the apparatuses shown in FIGS. 9 and 15 in which the slide cams 81, 81 stop when lowered by a predetermined amount or more, the apparatus 131 is not configured to stop the slide movement of the slide cams 133, 133 when the driver cams 137, 137 are lowered by a predetermined amount or more. Accordingly, the intermediate formed product 23 can be pressed from the sides. Therefore, when the intermediate formed product 23 is formed by using the die shown in FIG. 21, the upper die has to be stopped at a previously set height position.

Alternatively, as shown in FIG. 22, in processing the intermediate formed product 23 by use of the manufacturing apparatus 101, only a lower end portion of the intermediate formed product 23 may enter between the lower die inserts 113 and 113.

Advantages and effects (operations and results) achieved by the third embodiment will be described below.

(1) The manufacturing apparatus further includes: a pair of lower die inserts arranged below the slide cams; and a cushion pad provided so as to be vertically movable between the lower die inserts and supporting with an elastic force the bottom wall surface of the intermediate formed products 21 and 23 pressed downward. Therefore, when the intermediate formed products 21 and 23 are pressed downward, the intermediate formed product 23 tends to bulge in the width direction. However, because of high rigidity of the lower die inserts 113, 113, the corners 31, 31, 33, 33 can be crush-deformed without bulging of the intermediate formed product 23. Thus, a crush deformation amount can be properly set.

EXAMPLE

Examples of formability simulation for verifying the effects of the present invention will be described below.

FIGS. 23A through 23D are schematic front views showing a formability simulation of a square pipe forming process according to an example of the present invention among examples, FIG. 23A showing a state where the second intermediate formed product is set, FIG. 23B showing a state where flange parts of the second intermediate formed product are pressed by an upper die, FIG. 23C showing a state where side wall surfaces of the second intermediate formed product are pressed, and FIG. 23D showing a state where corners of the second intermediate formed product are crush-deformed. FIG. 24 is an enlarged view of the corner of the bottom wall surface in FIG. 23C. FIG. 25 is an enlarged view of the corner of the bottom wall surface in FIG. 23D. FIGS. 26A and 26B are schematic views showing distributions of stresses in respective portions of the square pipe shown in FIG. 23 when the square pipe is removed from the die, FIG. 26A showing a distribution of stresses in the inner fiber and FIG. 26B showing a distribution of stresses in the outer fiber. FIGS. 27A through 27E are schematic front views showing a formability simulation of a square pipe forming process according to a comparative example among the examples, FIG. 27A showing a state where an intermediate formed product is set, FIGS. 27B and 27C showing a state where a side wall part of the intermediate formed product is pressed from a side, and FIGS. 27D and 27E showing a state where a top wall surface is pressed downward. FIGS. 28A and 28B are schematic views showing distributions of stresses in respective portions of the square pipe shown in FIG. 27 when the square pipe is removed from the die, FIG. 28A showing a distribution of stresses in the inner fiber and FIG. 28B showing a distribution of stresses in the outer fiber.

As shown in FIGS. 23A through 25, the side wall surface 17 is curved to be convex outward in the width direction in the step shown in FIG. 23B, and the bottom wall surface 19 is flat and not curved to be convex downward throughout the steps shown in FIGS. 23A through 23D.

As shown in FIG. 26, it is found out that a tensile stress P1 acts on an outer side of a lower corner 31 of the completed square pipe 27 and a compressive stress P2 acts on an inner side thereof. Similarly, it is found out that a tensile stress P1 acts on an outer side of an upper corner 33 of the completed square pipe 27 and a compressive stress P2 acts on an inner side thereof. Note that, in addition to the corners described above, tensile stresses P1 act on outer sides of the side wall surface 17 and the bottom wall surface 19 of the completed square pipe 27 and compressive stresses P2 act on inner sides thereof.

On the other hand, in an intermediate formed product according to the comparative example, it is found out that a side wall surface 143 is not curved to be convex outward in the width direction in the step shown in FIG. 27B and that a bottom wall surface 145 is curved to be convex downward in the step shown in FIG. 27C.

Moreover, it is found out that, as shown in FIGS. 28A and 28B, a tensile stress P1 acts on an outer side of the bottom wall surface 145 and a compressive stress P2 acts on an inner side thereof. However, unlike the example of the present invention, almost no residual stress acts on the upper and lower corners.

The entire contents of Japanese Patent Application No. 2009-024846 (filed on Feb. 5, 2009) are incorporated herein by reference.

Although the invention has been described above by reference to certain embodiments of the invention, the invention is not limited to the embodiments described above. Modifications and variations of the embodiments descried above will occur to those skilled in the art, in light of the above teachings. The scope of the invention is defined with reference to the following claims.

What is claimed is:

1. A square pipe having an approximately rectangular closed cross section, the square pipe comprising:

a bottom wall surface, a pair of side wall surfaces orthogonal to the bottom wall surface and extend from both widthwise ends of the bottom wall surface, a top wall surface disposed across from the bottom wall surface and having a pair of flange parts in close contact with each other, wherein the square pipe is configured from a rectangular metal plate bent along a plurality of bend lines extending in a length direction of the metal plate, the pair of flange parts are butted against each other to provide the top wall surface, the flange parts and the bottom wall surface arranged opposite to the flange parts are parallel, each of four corners of the square pipe, including lower corners where the bottom wall surface and the side wall surfaces intersect with each other and upper corners where the side wall surfaces and the top wall surface intersect with each other, has residual stress that remains in the each of the four corners to bring the pair of flange parts into close contact with each other, the residual stress that remains in the each of the four corners includes a tensile stress at an outer corner surface of the square pipe and a compressive stress at an inner corner surface of the square pipe, and residual stresses, that bring the pair of flange parts into close contact with each other, remain on the side wall surfaces orthogonal to the flange parts.

* * * * *